US010181656B2

(12) United States Patent
Hansen

(10) Patent No.: US 10,181,656 B2
(45) Date of Patent: Jan. 15, 2019

(54) ANTENNA DETECTION WITH NON-VOLATILE MEMORY POWERED BY DC OVER COAXIAL CABLE

(71) Applicant: ADC Telecommunications, Inc., Shakopee, MN (US)

(72) Inventor: David Hansen, Sunnyvale, CA (US)

(73) Assignee: CommScope Technologies LLC, Hickory, NC (US)

( * ) Notice: Subject to any disclaimer, the term of this patent is extended or adjusted under 35 U.S.C. 154(b) by 68 days.

(21) Appl. No.: 14/244,037

(22) Filed: Apr. 3, 2014

(65) Prior Publication Data

US 2015/0111508 A1 Apr. 23, 2015

Related U.S. Application Data

(60) Provisional application No. 61/893,443, filed on Oct. 21, 2013.

(51) Int. Cl.
*H01Q 21/00* (2006.01)
*H01Q 21/28* (2006.01)

(52) U.S. Cl.
CPC ..... *H01Q 21/28* (2013.01)

(58) Field of Classification Search
CPC ..... H04B 7/024; H04B 7/028
USPC ..... 455/562.1, 575.7, 97, 121, 269
See application file for complete search history.

(56) References Cited

U.S. PATENT DOCUMENTS

| | | | | |
|---|---|---|---|---|
| 7,478,759 | B2 | 1/2009 | Lung | |
| 2005/0074123 | A1 | 4/2005 | Cromer et al. | |
| 2006/0066443 | A1 * | 3/2006 | Hall | G06K 7/10316 340/10.5 |

(Continued)

FOREIGN PATENT DOCUMENTS

| | | |
|---|---|---|
| CN | 1784813 | 6/2006 |
| CN | 101252713 | 8/2008 |

(Continued)

OTHER PUBLICATIONS

International Search Authority, "International Search Report for Application Serial No. PCT/US2014/052064", "for Foreign Counterpart U.S. Appl. No. 14/244,037", dated Nov. 26, 2014, pp. 112, Published in: WO.

European Patent Office, "Extended European Search Report for EP Application No. 14855574.1", "Foreign Counterpart to U.S. Application No.", dated May 26, 2017, pp. 18, Published in: EP.

State Intellectual Property Office of the People'S Republic of China, "First Office Action for CN Application No. 201480066774.2", "Foreign Counterpart to U.S. Appl. No. 14/244,037", dated Jan. 23, 2018, pp. 1-25, Published in: CN.

(Continued)

*Primary Examiner* — Wen Huang
(74) *Attorney, Agent, or Firm* — Fogg & Powers LLC

(57) ABSTRACT

In one embodiment, an antenna unit is provided that includes an antenna and a coax connector. The coax connector includes an inner conductor configured to contact a signal conductor of a coaxial cable and a ground contact configured to contact a metal shield of the coaxial cable. The coax connector is coupled to the antenna such that RF signals on the inner conductor are coupled to the antenna and such that RF signals sensed by the antenna are coupled to the inner conductor. The antenna unit also includes a non-volatile memory coupled to the coax connector such that the non-volatile memory can send and receive signals over the inner conductor. The non-volatile memory is configured to obtain operating power from a direct current voltage provided over a coaxial cable. The non-volatile memory has an identifier stored therein for identifying the antenna unit.

34 Claims, 6 Drawing Sheets

(56) References Cited

U.S. PATENT DOCUMENTS

| | | | | |
|---|---|---|---|---|
| 2007/0046549 | A1* | 3/2007 | Finn | H04B 1/18 343/702 |
| 2008/0198017 | A1 | 8/2008 | Hesselbarth et al. | |
| 2010/0013601 | A1* | 1/2010 | Wild | G01S 3/14 340/10.1 |
| 2011/0111709 | A1 | 5/2011 | Karacaoglu et al. | |
| 2011/0199920 | A1* | 8/2011 | Takei | G01S 13/767 370/252 |
| 2011/0275400 | A1 | 11/2011 | Timmins et al. | |
| 2013/0127666 | A1* | 5/2013 | Zhang | H01Q 1/246 342/359 |
| 2014/0016583 | A1 | 1/2014 | Smith | |
| 2014/0213285 | A1* | 7/2014 | Sauer | H04W 88/085 455/456.1 |

FOREIGN PATENT DOCUMENTS

| | | |
|---|---|---|
| CN | 102509893 | 6/2012 |
| KR | 20120057114 | 6/2012 |
| KR | 20130100419 | 9/2013 |

OTHER PUBLICATIONS

International Bureau, "International Preliminary Report on Patentability from PCT/US2014/052064 dated May 6, 2016", "from Foreign Counterpart of U.S. Appl. No. 14/244,037", May 6, 2016, pp. 1-9, Published in: WO.

Semiconductor Components Industries, LLC, "Wide Input Voltage Synchronous Buck Converter", Aug. 2011, Drawn from Internet site Http://onsemi.com, pp. 1-26.

State Intellectual Property Office, P.R. China, "Second Office Action from CN Application No. 201480066774.2 dated Sep. 13, 2018", from Foreign Counterpart to PCT Application No. PCT/US2014/052064, Sep. 13, 2018 pp. 1-21, Published: CN.

World Intellectual Property Organization, "International Application Published under Patent Cooperation Treaty from International Publication No. WO 2015/060931 A1 dated Apr. 30, 2015", "from Foreign counterpart of U.S. Appl. No. 14/244,037", Apr. 30, 2015, pp. 1-64, Published in: WO.

* cited by examiner

ANTENNA DETECTION WITH NON-VOLATILE MEMORY POWERED BY DC OVER COAXIAL CABLE

CROSS-REFERENCE TO RELATED APPLICATIONS

This application claims the benefit of priority to U.S. Provisional Application No. 61/893,443, filed on Oct. 21, 2013, the disclosure of which is hereby incorporated herein by reference.

BACKGROUND

It can be beneficial for a transceiver unit to be able to sense whether an antenna is coupled to the transceiver unit. This is particularly beneficial when the antenna is located remotely from the transceiver unit. One method of sensing the presence of an antenna is to sense band reflected RF power at the transceiver unit. This method is useful when the transceiver unit is coupled to a single antenna or when multiple bands of transceiver units are combined using multiplexers to one antenna.

SUMMARY

In one embodiment, an antenna unit is provided. The antenna unit includes an antenna and a coax connector configured to connect to a coaxial cable. The coax connector includes an inner conductor configured to contact a signal conductor of a coaxial cable connected thereto and a ground contact configured to contact a metal shield of the coaxial cable connected thereto. The coax connector is coupled to the antenna such that RF signals on the inner conductor are coupled to the antenna and radiated therefrom and such that RF signals sensed by the antenna are coupled to the inner conductor. The antenna unit also includes a non-volatile memory coupled to the coax connector such that the non-volatile memory can send and receive signals over the inner conductor. The non-volatile memory is configured to obtain operating power from a direct current voltage provided over a coaxial cable connected to the coax connector. The non-volatile memory has an identifier stored therein for identifying the antenna unit and is configured to send the identifier over the inner conductor in response to a read request received over the inner conductor.

DRAWINGS

DETAILED DESCRIPTION

In some systems a transceiver unit may be coupled to multiple antennas through one or more power dividers. In such systems, sensing reflected RF power at the transceiver unit is not effective in determining the presence or absence of a given antenna.

Figure 1:
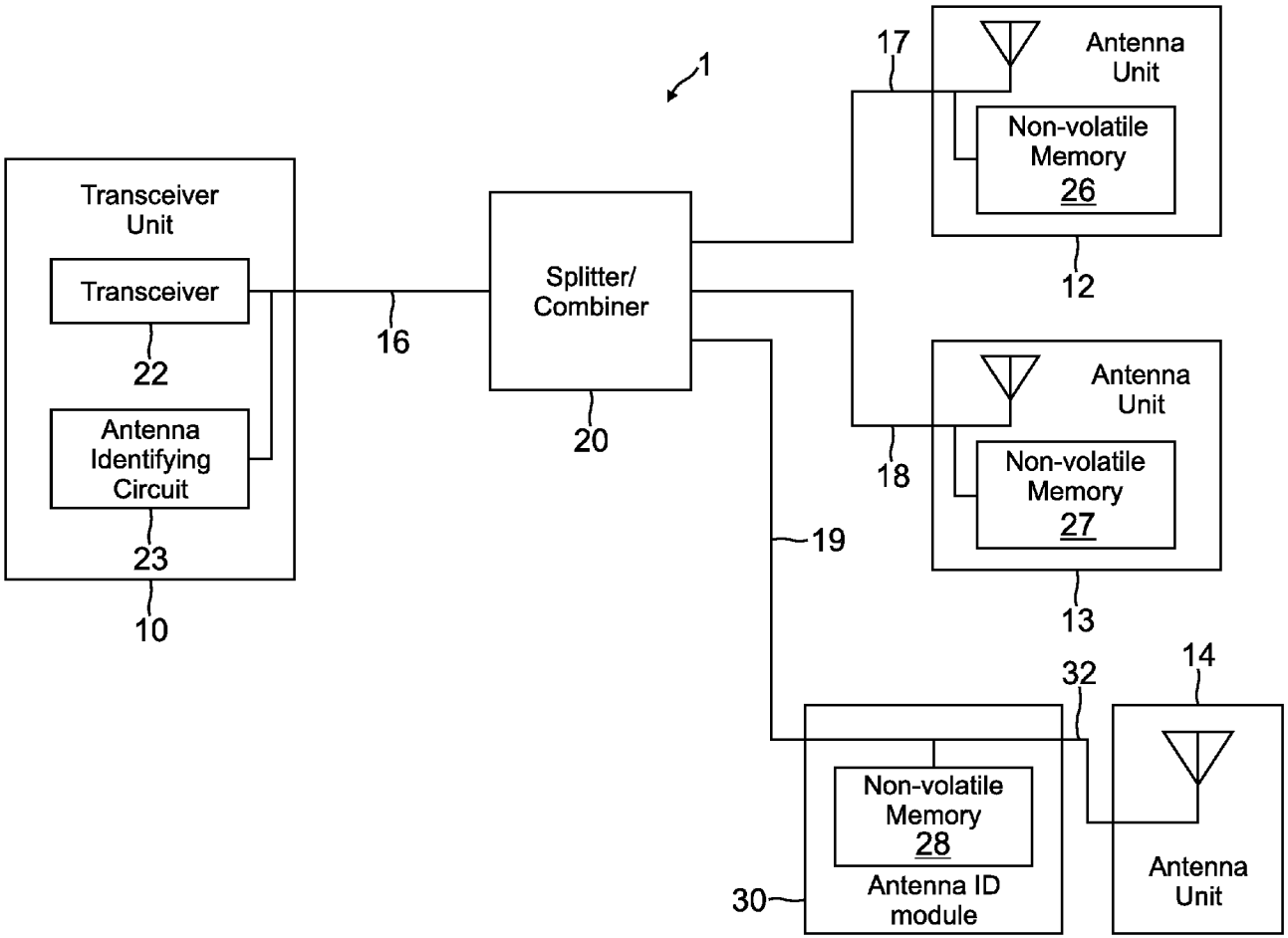
FIG. 1 is a block diagram of an example system including a transceiver unit coupled to a plurality of antennas.

FIG. 1 is a block diagram of an example system 1 including a transceiver unit 10 coupled to a plurality of antennas 12, 13, 14. The transceiver unit 10 is configured to transmit a radio frequency (RF) signal to the plurality of antennas 12, 13, 14, and the plurality of antennas are configured to radiate the RF signal therefrom. The plurality of antennas 12, 13, 14 are also configured to sense an RF signal for reception and couple the sensed RF signal to the transceiver unit 10. The transceiver is configured to receive the sensed RF signal.

The transceiver unit 10 is coupled to the plurality of antennas 12, 13, 14, via a plurality of coaxial cables 16-19 and one or more signal splitter/combiners 20. In the example shown in FIG. 1, a first coaxial cable to connected to the transceiver unit 10 on one end and the other end is connected to a combined port of the splitter/combiner 20. Each of antenna 12, 13, 14 also has a respective coaxial cable 17, 18, 19 connected thereto where the other end of the respective coaxial cable 17, 18, 19 is connected to respective separated inputs of the splitter/combiner 20.

In the downlink, the transceiver unit 10 is configured to transmit an RF signal over the first coaxial cable 16. The RF signal arrives at a combined port of the splitter/combiner 20 and is split such that the RF signal is sent to each of the separated ports of the splitter/combiner 20. The terms "combined port" refers to a port of splitter/combiner 20 in which a signal enters and is split to appear one a plurality of other ports (separated port). The term "separated port" refers to a port of the splitter/combiner 20 in which a signal that is input into a combined port and split into multiple signals is output from the splitter/combiner 20 on. In a bi-directional splitter/combiner 20, signals input into each of the separated ports are combined by the splitter/combiner 20 into a single composite signal that is output from the combined port.

The RF signal that is split by the splitter/combiner 20 is coupled to a second, third, and fourth coaxial cables 17, 18, 19 that are each coupled to a respective separated port of the splitter/combiner 20 and are in series with the first coaxial cable 16. Each RF signal from the splitter/combiner 20 is then coupled to a respective antenna 12, 13, 14, and radiated therefrom.

In the uplink, each antenna 12, 13, 14, is configured to sense wireless RF signals propagating thereto. An RF signal sensed by an antenna 12, 13, 14 is coupled to the respective coaxial cable 17, 18, 19 connected to the antenna 12, 13, 14. Each of the RF signals are then coupled to the splitter/combiner 20 which combines the RF signal from each antenna 12, 13, 14 into a composite RF signal that is coupled to the first coaxial cable 16. The composite RF signal is coupled to the transceiver unit 10 which receives the composited RF signal.

The transceiver unit 10 includes a RF transceiver 22 that is coupled to the first coaxial cable 16 and is configured to transmit and receive signals over the antennas 16-19 via the first coaxial cable 16. The transceiver unit 10 also includes an antenna identifying circuit 23 coupled to the first coaxial cable 16 and configured to detect the presence of antennas coupled to the first coaxial cable 16.

Each antenna unit 12, 13, 14, includes an antenna that is coupled to its respective coaxial cable 17, 18, 19. In this example, each antenna unit 12, 13, 14, is associated with a non-volatile memory 26, 27, 28 for detecting the presence of the antennas 12, 13, 14 by the antenna identifying circuit 23 in the transceiver unit 10. Each non-volatile memory 26, 27, 28 is co-located with its respective antenna unit 12, 13, 14. For example, a first non-volatile memory 26 is disposed within the antenna unit 12, that is, the first non-volatile memory 26 is disposed in a common housing with its associated antenna. The second non-volatile memory 27 is also disposed within the antenna unit 13. The third non-volatile memory 28 is disposed within an antenna identification (ID) module 30 (also referred to herein as an "in-line module 30") which is a distinct device from the antenna unit 14 with which the antenna ID module 30 is associated. As a distinct device, the antenna ID module 30 has a separate housing from the housing of the antenna unit 14. The fourth coaxial cable 19 is connected to one end of the antenna ID module 30 and the other end of the antenna ID module 30 is coupled to the antenna unit 14 with which the antenna ID module 30 is associated. In an example, a fifth coaxial cable 32 is used to couple the antenna ID module 30 to its associated antenna unit 14. That is, the antenna unit 14 is connected to one end of the fifth coaxial cable 32 and the antenna ID module 30 is connected to the other end of the fifth coaxial cable 32. The antenna ID module 30 is configured to pass an RF signal on the fourth coaxial cable 19 to the fifth coaxial cable 32 and to pass an RF signal on the fifth coaxial cable 32 to the fourth coaxial cable 19, such that the antenna ID module 30 is substantially transparent to the RF signals transmitted and received by the transceiver 22.

Regardless of whether the non-volatile memory 26, 27, 28 is disposed within an antenna unit 12, 13, 14, or in an in-line module 30, each non-volatile memory 26, 27, 28 can comprise a device having a one-wire interface which is capable of obtaining operating power and communicating over the same signal wire. The one-wire interface of each non-volatile memory is coupled to the RF path from the signal conductor of the respective coaxial cable 17, 18, 19, 32 to the antenna in the corresponding antenna unit 12, 13, 14 in a manner such that the non-volatile memory 26, 27, 28 is substantially transparent to the RF signals between the transceiver 22 and the respective antenna. The antenna identifying circuit 23 in the transceiver unit 10 is also coupled to the signal conductor of the first coaxial cable 16 connected to the transceiver unit 10. Accordingly, the antenna identifying circuit 23 in the transceiver unit 10 is communicatively coupled to the one-wire interface of each non-volatile memory 26, 27, 28 through the signal conductors of the first coaxial cable 16 and the respective second, third, and fourth coaxial cable 17, 18, 19. Advantageously since the communicative coupling between the antenna identifying circuit 23 and the respective non-volatile memory 26, 27, 28 is along the same path as the coupling between the transceiver 22 and the respective antenna unit 12, 13, 14, the communicative coupling between the antenna identifying circuit 23 and the respective non-volatile memory 26, 27, 28 can be used to detect the presence or absence of the respective antenna units 12, 13, 14. That is, the communicative coupling between the antenna identifying circuit 23 and respective non-volatile memory 12, 13, 14 can be used to determine whether the respective antenna unit 12, 13, 14 associated with each non-volatile memory 16, 17, 18 is coupled to the transceiver unit 22 (e.g., via one or more coaxial cables).

To detect the presence or absence of an antenna unit 12, 13, 14, the antenna identifying circuit 23 is configured to send a read request over the signal conductor of the first coaxial cable 16 connected to the transceiver unit 10. In an example, the read request is sent as a digital signal of serial data having a frequency that is significantly lower than a frequency range of RF signals transmitted and received by the transceiver 22. In this way, the read request and the RF signals can be separated with minimal affect on one another. The read request is sent over the first coaxial cable 16 and is coupled by the splitter/combiner 20 to any coaxial cables coupled to the first coaxial cable 16. In the example shown in FIG. 1, the read request is coupled by the splitter/combiner 20 onto the second, third, and fourth coaxial cables 17, 18, 19. The read request propagates along each of the second, third, and fourth coaxial cables 17, 18, 19 and is coupled to each non-volatile memory 26, 27, 28 through their respective coupling to their respective coaxial cable 17, 18, 19. Each non-volatile memory 26, 27, 28 receives the read request at its one-wire interface and determines whether to send a response, and, if a response is to be sent, what response to send. In an example, the read request is a general read request that is directed to any non-volatile memory coupled to the RF path of the first coaxial cable 16. In such an example, each of the non-volatile memories 26, 27, 28 will respond to the read request. Such a read request can be used by the antenna identifying circuit 23 to obtain an inventory of all antenna units 26, 27, 28 coupled to the transceiver unit 10. In another example, the read request is directed to a specific non-volatile memory, such as by including an identifier for the non-volatile memory in which the read request is directed. In an implementation of such an example, the read request is directed to the non-volatile memory 26 associated with the antenna unit 12. Such a read request will be received by each of the non-volatile memories 26, 27, 28 coupled to the RF path of the first coaxial cable 16. Only the non-volatile memory 26 to which the read request is directed, however, will respond. The other non-volatile memories 27, 28 will remain silent. This type of read request can be used to detect the presence or absence of the specific antenna unit 12.

Similar to the read request, a response from a non-volatile memory 26, 27, 28 can be sent as a digital signal of serial data from the one-wire interface of the non-volatile memory 26, 27, 28. The response can have a frequency that is significantly lower than a frequency range of RF signals transmitted and received by the transceiver 22. In this way, the response and the RF signals can be separated with minimal affect on one another. In an example, the response can include an identifier for the non-volatile memory 26, 27, 28 and/or an identifier for the respective antenna unit 12, 13, 14 with which the non-volatile memory 26, 27, 28 is associated. In some examples, the response can include attribute information for the respective antenna unit 12, 13, 14 with which the non-volatile memory 26, 27, 28 is associated. The attribute information can include a location of the antenna unit 12, 13, 14, a type of antenna in the antenna unit 12, 13, 14, a frequency band for the antenna unit 12, 13, 14, and/or other information. For example, a response from the non-volatile memory 26 can include an identifier for the non-volatile memory 26 and/or an identifier for the antenna unit 12. The response from the non-volatile memory 26 could also include attribute information for the antenna unit 12. Similarly, a response from the non-volatile memory 28 can include an identifier for the non-volatile memory 28 and/or an identifier for the antenna unit 14. The response from the non-volatile memory 28 could also include attribute information for the antenna unit 14. In some examples, the attribute information can be sent in response to a request for such attribute information.

Each non-volatile memory 26, 27, 28 is configured to send the respective response over the signal conductor of the respective coaxial cable 17, 18, 19 coupled thereto. A response sent on the signal conductor of a respective coaxial cable 17, 18, 19 is coupled to the first coaxial cable 16 through the splitter/combiner 20 and is received by the antenna identifying circuit 23. The antenna identifying circuit 23 receives the response and determines that the antenna unit 12, 13, 14 associated with the non-volatile memory 26, 27, 28 from which the response was received is present (i.e., coupled to the transceiver unit 10). The antenna identifying circuit 23 can then store the identifier for the non-volatile memory 26, 27, 28 and/or antenna unit 12, 13, 14, and/or any attribute information in the response. Such information in the response can be stored or sent to another entity (e.g., an aggregation point) for inventory management or other purposes. If one of the antenna units 12, 13 is not coupled to transceiver unit 10 through the respective coaxial cable 17, 18, a non-volatile memory 26, 27 disposed therein will also not be coupled to the transceiver 10. In such a circumstance, a read request sent by the antenna identifying circuit 23 will not be received by the non-volatile memory 26, 27, and the antenna identifying circuit 23 will determine based on the lack of a response that the corresponding antenna unit 12, 13 is not present (i.e., absent, not coupled to the transceiver unit 10). Similarly, if the antenna unit 14 is not coupled to the transceiver unit 10 through its respective coaxial cable 19 (e.g., through the coaxial cable 32 and in-line module 30), the in-line module 30 associated with the antenna unit 14 will also likely not be coupled to the transceiver unit 10. In such a circumstance the non-volatile memory 28 will not receive the read request, and the antenna identifying circuit 23, therefore, will not receive a response. An antenna unit 12, 13, 14 may not be coupled to the transceiver unit 10 due to, for example, disconnection by an operator, a severed cable between the antenna unit 12, 13, 14, and the transceiver unit 10, or due to a shorted cable caused by a smashed cable or improper connection.

The antenna identifying circuit 23 can be configured to determine that a particular antenna unit 12, 13, 14 is not present if a response from the associated non-volatile memory 26, 27, 28 is not received within a certain amount of time after sending a read request directed to the particular antenna unit 12, 13, 14 or non-volatile memory 26, 27, 28. In some examples, the antenna identifying circuit 23 is configured to wait to determine that a particular antenna unit 12, 13, 14 is not present until no response has been received from multiple (e.g., two) responses. In any case, information indicating that a particular antenna unit 12, 13, 14, is not present can be stored at the transceiver unit 10 and/or sent to another device (e.g., an aggregation point) for inventory management or other purposes.

Figure 2:
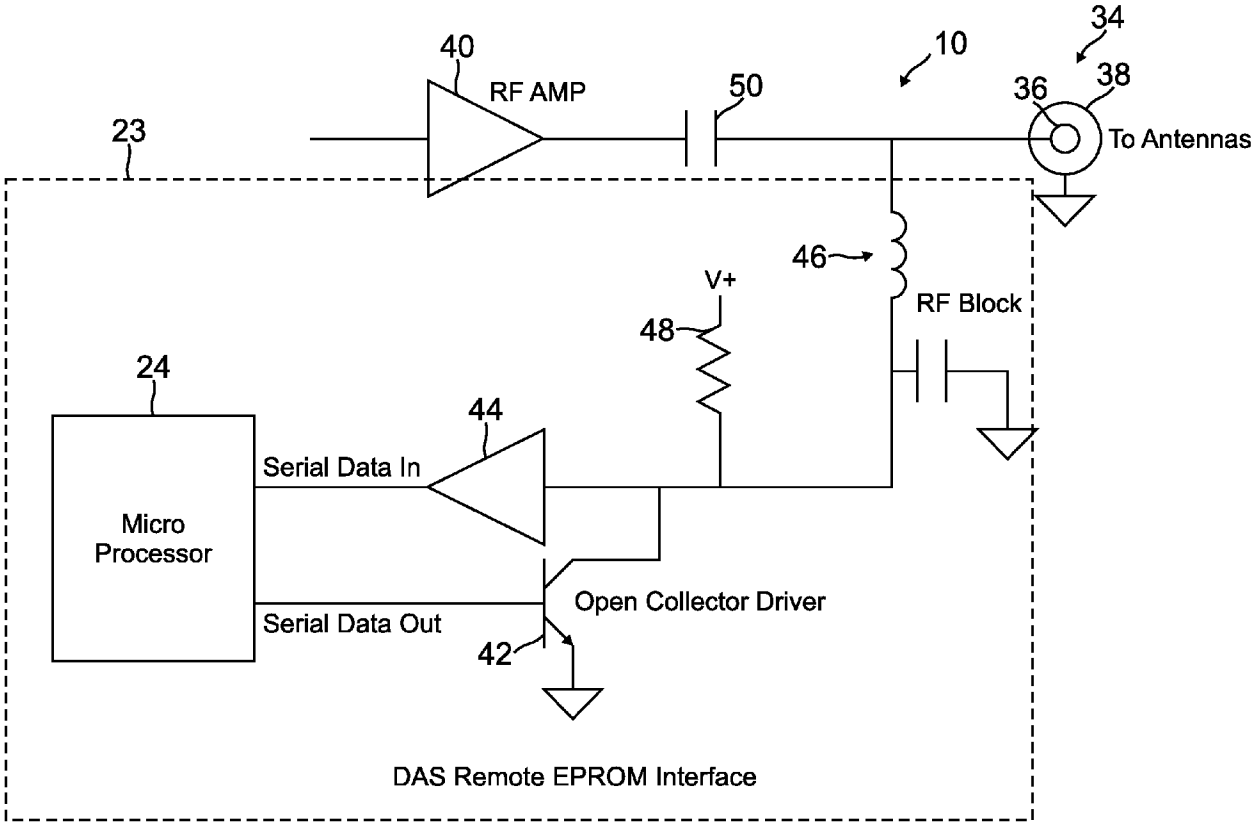
FIG. 2 is a circuit diagram of a portion of an example transceiver unit including an antenna identifying circuit for detecting the presence of an antenna coupled to the transceiver unit.

FIG. 2 is a circuit diagram of a portion of an example transceiver unit 10 including an antenna identifying circuit 23 for detecting the presence of an antenna coupled to the transceiver unit 10. The transceiver unit 10 includes a connector 34 for connecting to a coaxial cable (such as the first coaxial cable 16). The connector 34 includes an inner conductor 36 and a ground contact 38. The inner conductor 34 is configured to contact a signal conductor (i.e., the inner conductor) of a coaxial cable connected to the connector 34. As known, a coaxial cable includes an inner conductor that extends through the center of the cable. The inner conductor of a coaxial cable is also referred to herein as the "signal conductor", since this is typically the conductor in the coaxial cable through which the desired signal is propagated. The signal conductor of a coaxial cable is surrounded by an insulating material. On the outside of the insulating material is a metal shield that is typically used as a noise shield for signals on the signal (inner) conductor. The metal shield is often in the form of a mesh around the insulating material. In some examples, the metal shield includes more than one layer of mesh with insulating material between adjacent layers. Typically the metal shield is coupled to ground to aid in its use as a noise shield.

In any case, the inner conductor 36 of the connector 34 is configured to contact the signal conductor of a coaxial cable connected to the connector 34. The ground contact 38 of the connector 34 is configured to contact the metal shield of a coaxial cable connected to the connector 34. The ground contact 38 is coupled to ground in order to couple the metal shield of a coaxial cable connected to the connector 34 to ground. The inner conductor 36 of the connector 34 is coupled to the transceiver 22 of the transceiver unit 10, such that the transceiver 22 can transmit and receive RF signals through the inner conductor 36 of the connector 34 and over a signal conductor of a coaxial cable connected to the connector 34. FIG. 2 illustrates an amplifier 40 of the transceiver 22 coupled to the inner conductor 36.

The antenna identifying circuit 23 includes a processing device 24 that is coupled to the inner conductor 36 of the connector 34, such that the processing device 24 can sent a read request and receive a response through the inner conductor 36 of the connector 34 and over a signal conductor of a coaxial cable connected to the connector 34. In the example shown in FIG. 2, the processing device 24 is coupled to the inner conductor 36 in the transmit path through an open collector driver 42. The processing device 24 is coupled to the inner conductor 36 in the receive path through an amplifier 44. The transmit and receive path are coupled together and an RF block 46 is coupled between the processing device 24 and the RF path between the transceiver 22 and the inner conductor 36. The RF block 46 is configured to block RF signals propagating between the transceiver 22 and the inner conductor 36 from reaching the processing device 24. In the example shown in FIG. 2, the RF block 46 includes an inductor in series between the RF path and the processing device 24 and a capacitor in connected to the processing device 24 side of the inductor and to ground. The processing device 24 can also be configured to send a request for attribute information and/or a write request to a non-volatile memory 26, 27, 28.

The transceiver unit 10 is also configured to apply a direct current (DC) voltage to the inner conductor 36 of the connector 34, such that the DC voltage is coupled to the signal conductor of a coaxial cable connected to the connector 34. The DC voltage is the operating power for any non-volatile memories 26, 27, 28 coupled to the signal conductor of a coaxial cable connected to the connector 34. In the example shown in FIG. 1, this DC voltage applied by the transceiver unit 10 is coupled through the first coaxial cable 16 through the splitter/combiner 20 and onto each of the second, third, and fourth coaxial cables 17, 18, 19. The DC voltage is then coupled to each of the non-volatile memories 26, 27, 28 through their coupling with their respective coaxial cables 17, 18, 19. As mentioned above, the DC voltage is coupled by the transceiver unit 10 to the inner conductor 36 of the connector 34, and, therefore, to the signal conductor of the first coaxial cable 16 which is connected to the connector 34. The splitter/combiner 20 couples the signal conductor of the first coaxial cable 16 to the signal conductors of any coaxial cable 17, 18, 19 connected to a separated output of the splitter/combiner 20. Accordingly, the DC voltage is coupled through the splitter/ combiner 20 from the signal conductor of the first coaxial cable to the signal conductors of the second, third, and fourth coaxial cables 17, 18, 19. The non-volatile memories 26, 27, 28 are coupled to the signal conductor of their respective coaxial cable 17, 18, 19 and obtain the DC voltage therefrom. In the example shown in FIG. 2, the DC voltage is coupled to the inner conductor 36 through a pull-up resistor 48 that is coupled to the processing device 24 side of the inductor of the RF block 46. In an example, a DC block capacitor 50 is coupled in series between the amplifier 40 of the transceiver 22 and the read-response path to and from the processing device 24.

Although described herein in the singular form for simplicity, the processing device 24 can include one or more processing devices 24 for executing instructions. The one or more processing devices 24 can include a general purpose processor or a special purpose processor, such as a microprocessor. Instructions for execution by the one or more processors 24 are stored (or otherwise embodied) on or in an appropriate storage medium or media (not shown) (such as flash or other non-volatile memory) from which the instructions are readable by the one or more processing devices for execution thereby. The transceiver unit 10 also includes memory (not shown) that is coupled to the one or more processing devices 24 for storing instructions (and related data) during execution by the one or more processing devices 24. Such memory comprises, in one implementation, any suitable form of random access memory (RAM) now known or later developed, such as dynamic random access memory (DRAM). In other implementations, other types of memory are used.

Figure 3:
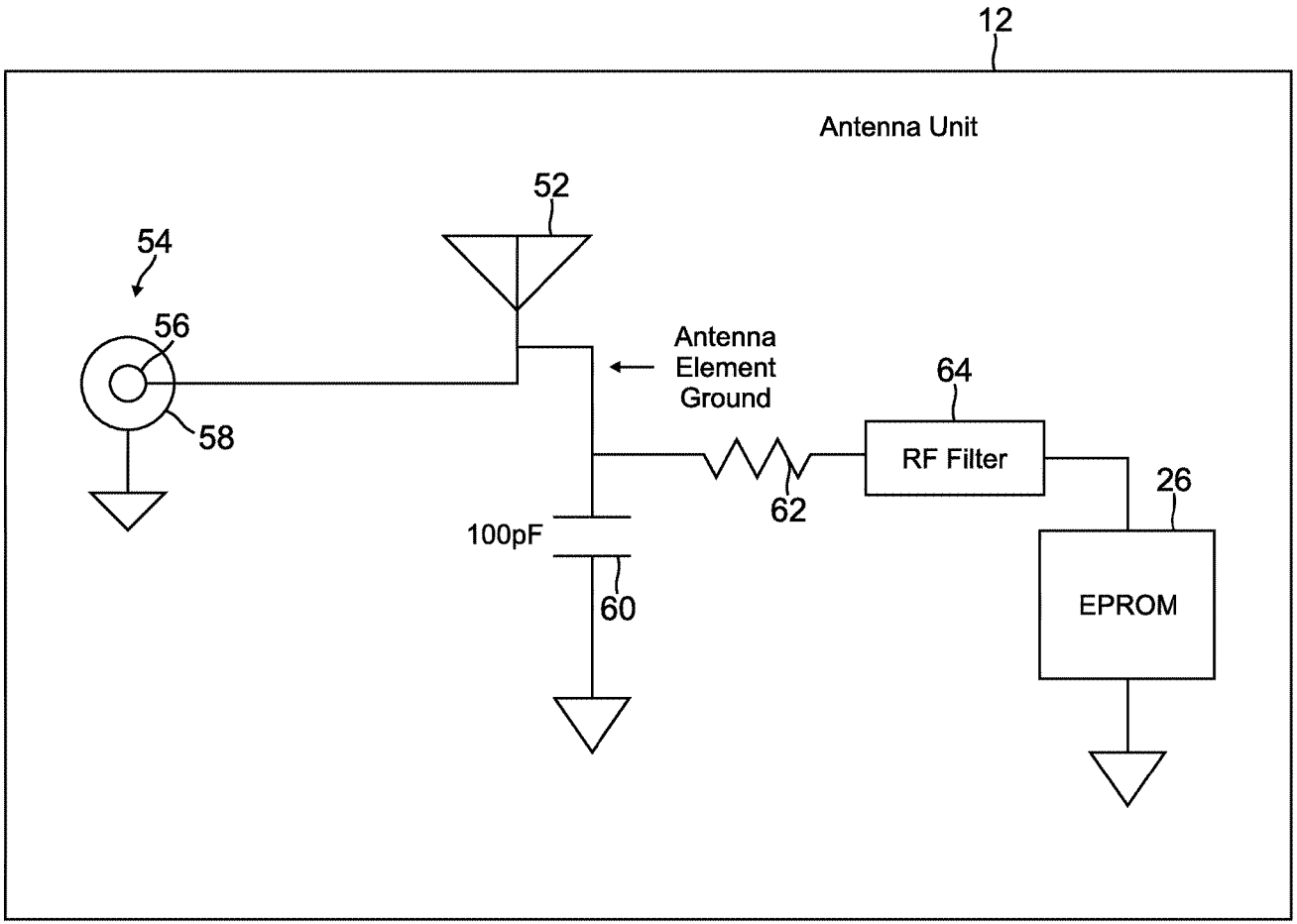
FIG. 3 is a circuit diagram of an example antenna unit having a non-volatile memory disposed therein.

FIG. 3 is a circuit diagram of an example antenna unit 12 having a non-volatile memory 26 disposed therein. As discussed above, the one-wire interface of the non-volatile memory 26 is coupled to the RF path to and from the antenna 52 in the antenna unit 12. This RF path in the antenna unit 12 extends between the antenna 52 and an inner conductor 56 of a coaxial connector 54 of the antenna unit 12. Similar to coaxial connector 34 of the transceiver unit 10, the coaxial connector 54 of the antenna unit 12 is configured to connect to a coaxial cable (such as the second coaxial cable 17) such that RF signals are coupled between the signal conductor of the coaxial cable and the antenna 52. The inner conductor 56 of the connector 54 is configured to contact a signal conductor of a coaxial cable connected to the connector 54 and a ground contact 58 of the connector 54 is configured to contact a metal shield of a coaxial cable connected to the connector 54. The ground contact 58 of the connector 54 is coupled to ground in order to couple the metal shield of a coaxial cable connected to the connector 54 to ground. The inner conductor 56 of the connector 54 is coupled to the antenna 52 of the antenna unit 12, such that an appropriate RF signal from a signal conductor of a coaxial cable connected to the connector 34 is radiated from the antenna 52 and an RF signal sensed by the antenna 52 is coupled to the signal conductor of the coaxial cable connected to the connector 34.

The non-volatile memory 26 is coupled to the RF path in a manner that allows the DC voltage applied by the transceiver unit 10 to reach the one-wire interface of the non-volatile memory 26. The non-volatile memory 26 is configured to use the DC voltage at the one-wire interface for operating power. Since the DC voltage is applied onto the RF path (i.e., the signal conductor of the coaxial cable 16) by the transceiver unit 10, the non-volatile memory 26 is configured to obtain the DC voltage along the same path as used by the communications between the processor 24 of the transceiver unit 10 and the non-volatile memory 26. The one-wire interface of the non-volatile memory 26 is coupled to this path and is capable of obtaining operating power and communicating over the same signal wire.

In an example, a ground connection (i.e., a ground element that is part of an RF matching circuit) of the antenna 52 is coupled to ground through a capacitor 60 in series between the ground connection of the antenna 52 and ground. The one-wire interface of the non-volatile memory 26 is also coupled to the ground connection of the antenna 52. Through this ground connection of the antenna 52, the one-wire interface of the non-volatile memory 26 is coupled to the RF path between the antenna 52 and the inner conductor 56 of the coaxial connector 54. In particular, the one-wire interface of the non-volatile memory 26 is coupled to the end of the capacitor 60 that is coupled to the ground connection of the antenna 52; that is, the end of the capacitor 60 that is not coupled to ground. The capacitor 60 is configured to isolate the DC on the RF path for the non-volatile memory 26, thereby enabling the DC voltage to be obtained by the non-volatile memory 26. The capacitor 60 is also configured to couple any high frequency RF energy at the ground connection of the antenna 52 to ground, thereby reducing the high frequency RF energy that reaches the non-volatile memory 26. A resistor 62 is coupled in series between the non-volatile memory 26 and the ground connection of the antenna 52.

An RF filter 64 can also be coupled in series between the ground connection of the antenna 52. The RF filter 64 is configured to further filter out RF signals transmitted and received by the transceiver 22 such that these RF signals are attenuated before reaching the one-wire interface of the non-volatile memory 26. The RF filter is also configured to allow signals between the processor 24 of the transceiver unit 10 and the non-volatile memory 26 to pass through with minimal attenuation such that read requests and responses can be sent between the processor 24 and the non-volatile memory 26. In an example, the RF filter 64 is a low-pass filter which allows the lower frequency communications between the processor 24 and the one-wire interface of the non-volatile memory 26 to pass through and attenuates the higher frequency RF signals between the transceiver 22 of the transceiver unit 10 and the antenna 52. A ground connection of the non-volatile memory 26 is coupled to ground.

In examples where the antenna unit 12 is not grounded, the non-volatile memory 26 is connected in a different manner. In particular, the one-wire interface of the non-volatile memory 26 is coupled to the RF path between the inner conductor 56 of the coaxial connector 54 and the non-grounded antenna. A resistor and RF filter can be coupled in series between the one-wire interface and the RF path. In an example, no capacitor is used with a non-grounded antenna.

Figure 4:
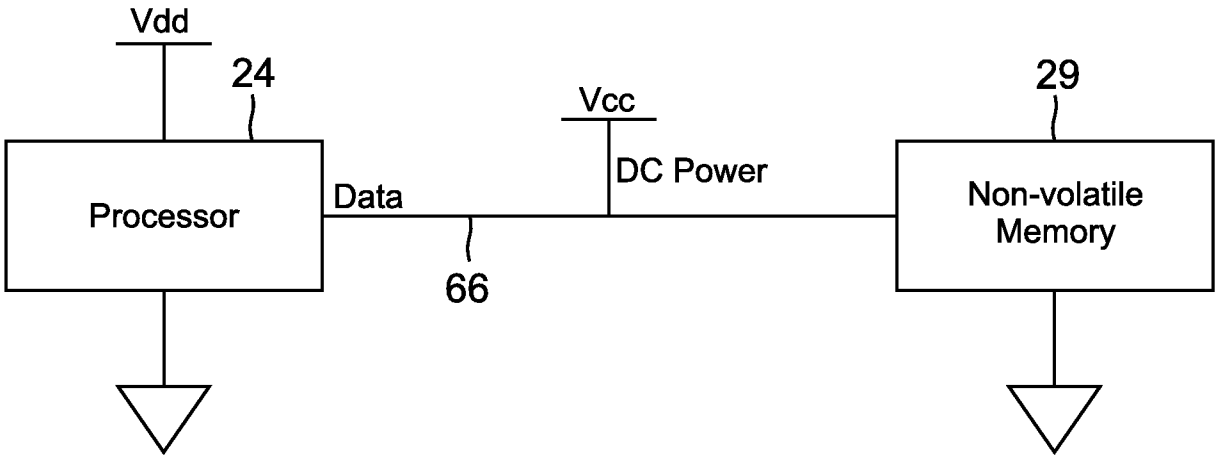
FIG. 4 is a block diagram of an example communicative coupling between a processor and a non-volatile memory having a 1-wire interface.

FIG. 4 is a block diagram of an example communicative coupling between a processor (such has processor 24) and a non-volatile memory 29 having a 1-wire interface. Non-volatile memory 29 can comprise non-volatile memory 26, 27, or 28 described herein. For simplicity, the coaxial cables and other components (e.g., splitter/combiner 20) between the processor 24 and the non-volatile memory 29 are not shown in FIG. 4. As shown, the processor 24 is coupled to its operating power, Vdd, and ground. The processor 24 is configured to send and receive data over a single path 66 (e.g., a single wire) to and from the non-volatile memory 29. In the example shown in FIG. 1, this single path 66 includes the signal conductor of the various coaxial cables 16, 17, 18, 19. In the example discussed with respect to FIG. 1, receiving data includes receiving messages, such as a read request, from the transceiver 22. Sending data includes sending messages, such as a response to the read request, from the transceiver 22. As discussed above with respect to FIG. 2, DC power, Vcc, is also coupled to the single path 66 over which the data between the processor 24 and the non-volatile memory 29 is communicated. In this example, the DC power, Vcc, is coupled to the single path 66 by the transceiver unit 10.

The non-volatile memory 29 has a 1-wire interface that is coupled to the single path 66. The non-volatile memory 29 is configured to obtain operating power from the DC power, Vcc, on the single path 66 and is configured to send and receive data with the processor 24 over the single path 66. The non-volatile memory 29 can also be coupled to ground. Although a single non-volatile memory 29 is shown in FIG. 4, it should be understood that the 1-wire interface of each of more than one non-volatile memory can be coupled to the single path 66. An example non-volatile memory suitable for use as non-volatile memory 26, 27, 28, 29 is the BQ2026 1.5K-Bit Serial EPROM with SDQ Interface manufactured by Texas Instruments. In an example, the non-volatile memory 26, 27, 28, 29 can include an erasable programmable read only memory (EPROM).

Figure 5:
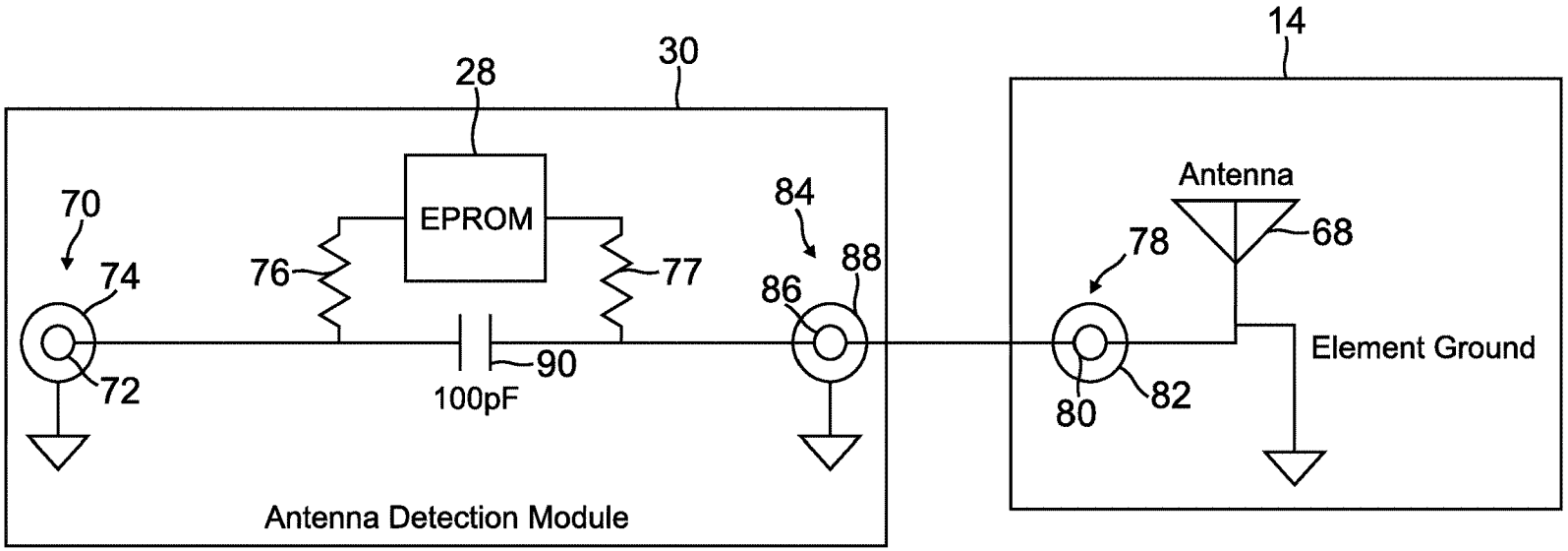
FIG. 5 is a block diagram of an example in-line antenna ID module coupled to an antenna unit that does not have a non-volatile memory disposed therein.

FIG. 5 is a block diagram of an example in-line antenna ID module 30 coupled to an antenna unit 14 that does not have a non-volatile memory disposed therein. The antenna unit 14 includes an antenna 68 that is configured to be coupled to the RF path used by the transceiver 22 to transmit and receive RF signals. In particular, the antenna 68 is coupled to an inner conductor 80 of a coaxial connector 78 of the antenna unit 14. Similar to the coaxial connectors 34, 54 discussed above, the coaxial connector 78 is configured to connect to a coaxial cable (such as coaxial cable 32 of FIG. 1) such that a signal conductor of the coaxial cable connected to the connector 78 contacts the inner conductor 80. Likewise, a ground contact 82 of the coaxial connector 78 is configured to contact the metal shield of a coaxial cable connected to the connector 78. The ground contact 82 can also be coupled to ground. RF signals on the RF path between the antenna 68 and the transceiver 22 are coupled therebetween through the inner conductor 80 of the connector 78. The antenna 68 can also be coupled to ground.

The RF path between the transceiver 22 and the antenna 68 propagates through the in-line antenna ID module 30. As such the in-line antenna ID module 30 is coupled in series on the RF path between the antenna unit 14 (in particular the antenna 68) and the transceiver 22.

The in-line antenna ID module 30 includes a first coaxial connector 70 having an inner conductor 72 and a ground contact 74. Similar to the coaxial connectors 34, 54 discussed above, the coaxial connector 70 is configured to connect to a coaxial cable (such as coaxial cable 19 of FIG. 1) such that a signal conductor of the coaxial cable connected to the connector 70 contacts the inner conductor 72. Likewise, the ground contact 74 is configured to contact the metal shield of a coaxial cable connected to the connector 70.

The in-line antenna ID module 30 includes the non-volatile memory 28, which can be coupled to the transceiver unit 10 and operates as described above with respect to non-volatile memory 29 of FIG. 4. As such the non-volatile memory 28 has a 1-wire interface which is coupled to the inner conductor 72 of the connector 70. Through this coupling to the inner conductor 72, the 1-wire interface of the non-volatile memory 26 is coupled to the RF path between the antenna 68 and the transceiver 22 in the transceiver unit 10. A resistor 76 is coupled in series between the 1-wire interface of the non-volatile memory 26 and the inner conductor 72.

The in-line antenna ID module 30 is also coupled to the antenna unit 14. The antenna ID module 30 is configured to pass the RF signals to and from the transceiver 22 through the antenna ID module 30 and to the antenna unit 14. In an example, the antenna ID module 30 and the antenna unit 14 are coupled together through a coaxial cable (such as coaxial cable 32). In other examples, however, the in-line antenna ID module 30 can be coupled to the antenna unit 14 in other manners, such as by connecting directly to the coaxial connector 78. In examples where the in-line antenna ID module 30 is coupled to the antenna unit 14 with a coaxial cable 32, the in-line antenna ID module 30 includes a second coaxial connector 84 having an inner conductor 86 and a ground contact 88. Similar to the coaxial connectors 34, 54 discussed above, the coaxial connector 84 is configured to connect to a coaxial cable (such as coaxial cable 32 of FIG. 1) such that a signal conductor of the coaxial cable connected to the connector 84 contacts the inner conductor 86. Likewise, the ground contact 88 is configured to contact the metal shield of a coaxial cable connected to the connector 84.

The inner conductor 86 of the second coaxial connector 84 is RF coupled to the inner conductor 72 of the first coaxial connector 70 such that RF signals transmitted and received by the transceiver 22 are passed between the inner conductor 72 of the first connector 70 and the inner conductor 86 of the second connector 84. In this way, the in-line antenna ID module 30 is substantially transparent to the RF signals between the transceiver 22 and the antenna unit 14. The in-line antenna ID module 30 includes a capacitor 90 in series in the RF path between the inner conductor 72 of the first connector 70 and the inner conductor 86 of the second connector 84. A first end of the capacitor 90 is coupled to the inner conductor 72 of the first connector 70 and a second end of the capacitor 90 is coupled to the inner conductor 86 of the second connector 84. The 1-wire interface of the non-volatile memory 28 is coupled to the first end of the capacitor 90 and a ground connection of the non-volatile memory 28 is coupled to the second end of the capacitor 90. The capacitor 90 acts as DC block, blocking the DC voltage applied by the transceiver unit 10 on the RF path. In particular, the capacitor 90 blocks the DC voltage from the ground connection of the non-volatile memory 28. The ground connection of the non-volatile memory 28 is coupled to the second end of the capacitor 90. Thus, the capacitor 90 enables the DC voltage to be obtained at the 1-wire interface of the non-volatile memory 28 and blocks the DC voltage on the RF path from the ground connection of the non-volatile memory 28. In an example, the ground connection of the non-volatile memory 28 is coupled to ground via the grounded antenna 68 in the antenna unit 14. In particular, when the antenna unit 14 is coupled to the second connector 84, the RF path is coupled to the ground by the ground connection of the antenna 68. Thus, the ground connection of the non-volatile memory 28 is coupled to ground through the inner conductor 86 of the second connector 84, which is coupled to the signal conductor of the coaxial cable 32, which is coupled to the inner conductor 80 of the connector 78, which is coupled to ground via the grounded antenna 68. The capacitor 90 can also act to block the RF signals transmitted and received by the transceiver 22 from reaching the non-volatile memory 28, thereby bypassing the non-volatile memory 28 for the RF signals transmitted and received by the transceiver 22. In an example, the capacitor 90 has a capacitance value of around 100 pF. A resistor 77 can be coupled between the ground connection of the non-volatile memory 28 and the RF path.

The non-volatile memory 28 is configured to use the DC voltage on the RF path for operating power. Since the DC voltage is applied onto the RF path (i.e., the signal conductor of the coaxial cable 16) by the transceiver unit 10, the non-volatile memory 28 is configured to obtain the DC voltage along the same path as used by the communications between the processor 24 of the transceiver unit 10 and the non-volatile memory 28. The 1-wire interface of the non-volatile memory 28 is coupled to this path and is capable of obtaining operating power and communicating over the same signal wire.

In an example, the module 30 is configured such that the non-volatile memory selectively sends a response to a read request from the transceiver 22 based on whether or not an antenna unit 14 is coupled to the module 30. In particular, the module 30 is configured such that the non-volatile memory 28 sends a response to a read request when an antenna unit 14 is coupled to the second connector 84 and does not send a response to a read request when an antenna unit 14 is not connected to the second connector 84.

In an example, the module 30 is configured such that the non-volatile memory 28 selectively sends a response to a read request by being configured such that the ground connection of the non-volatile memory 28 is selectively coupled to the ground based on whether or not an antenna unit 14 is coupled to the second connector 84. In particular, the module 30 is configured such that the ground connection of the non-volatile memory 28 is not coupled to ground (e.g., the ground connection is floating) when the antenna unit 14 is not connected to the second connector 84, and the ground connection of the non-volatile memory 28 is connected to ground when the antenna unit 14 is coupled to the second connector 84. Since the non-volatile memory 28 does not function when the ground connection is not coupled to ground, the non-volatile memory 28 will not send a response to a read request when the ground connection is not coupled to ground. When the ground connection is coupled to ground, however, the non-volatile memory 28 will function and respond to a read request. Accordingly, configuring the module 30 such that the ground connection of the non-volatile memory 28 is selectively coupled to ground based on whether or not the antenna unit 14 is coupled to the module 30, acts to control whether or not the non-volatile memory 28 responds to a read request based on whether or not the antenna unit 14 is coupled to the module 30.

In the example shown in FIG. 5, the module 30 is configured to selectively couple the ground connection of the non-volatile memory 28 to ground based on whether or not the antenna unit 14 is coupled to the module 30 by coupling the ground connection of the non-volatile memory 28 to the inner conductor 86 of the second connector 84. When a DC grounded antenna 68 in an antenna unit 14 is coupled to the second connector 84, the inner conductor 86 is coupled to DC ground through, for example, the coaxial cable 32 and the DC ground connection of the antenna 68. When an antenna unit 14 is not coupled to the connector 84, the inner conductor 86 is floating. Such a configuration works for a DC grounded antenna 68.

In another example, the in-line antenna ID module 30 is configured for use with a non-DC grounded antenna 68. In such an example, the non-volatile memory 28, resistors 76, and capacitor 90 are connected in the same manner as discussed with respect to FIG. 5. Since the antenna 68 in this example is not grounded, however, the ground connection of the non-volatile memory 28 can be coupled to ground via an inductor that is connected on one end to the RF path between the capacitor 90 and the antenna unit 68 (e.g., to the inner conductor 86 of the second coaxial connector 84) and on the other end to ground. The inductor acts as a DC ground on the RF path for the non-volatile memory 28. In such an example, the non-volatile memory 28 will send a response to a read request regardless of whether or not an antenna unit 14 is coupled to the second connector 84. However, the antenna detection provided by the module 30 can still be relied upon if the module 30 is co-located with the antenna unit 14, since if that is the case, disconnection of the antenna unit 14 by unintentional wire cutting is unlikely.

Referring back to FIG. 1, in an example, the non-volatile memories 26, 27, 28 are configured to have data stored thereon over the 1-wire interface. For example, a programming device can be coupled to the coaxial connector (e.g., connector 54 of an antenna unit 12, 13, or connector 72 of an in-line module 30) by an installer during installation of antenna unit 12, 13 or during installation of an antenna unit 14 with associated in-line module 30. The installer can program the non-volatile memory 26, 27, 27 with attributes for the associated antenna, such as the location of the associated antenna. In an example, the non-volatile memories 26, 27, 28 can be configured to have data stored therein after installation by the transceiver 22. For example, the transceiver 22 can store attributes of the associated antenna and/or other attributes of the system 1 into one or more of the memories 26, 27, 28 by sending messages through the coaxial cables 16, 17, 18, 19 to the one or more memories 26, 27, 28 as discussed above.

Figure 6:
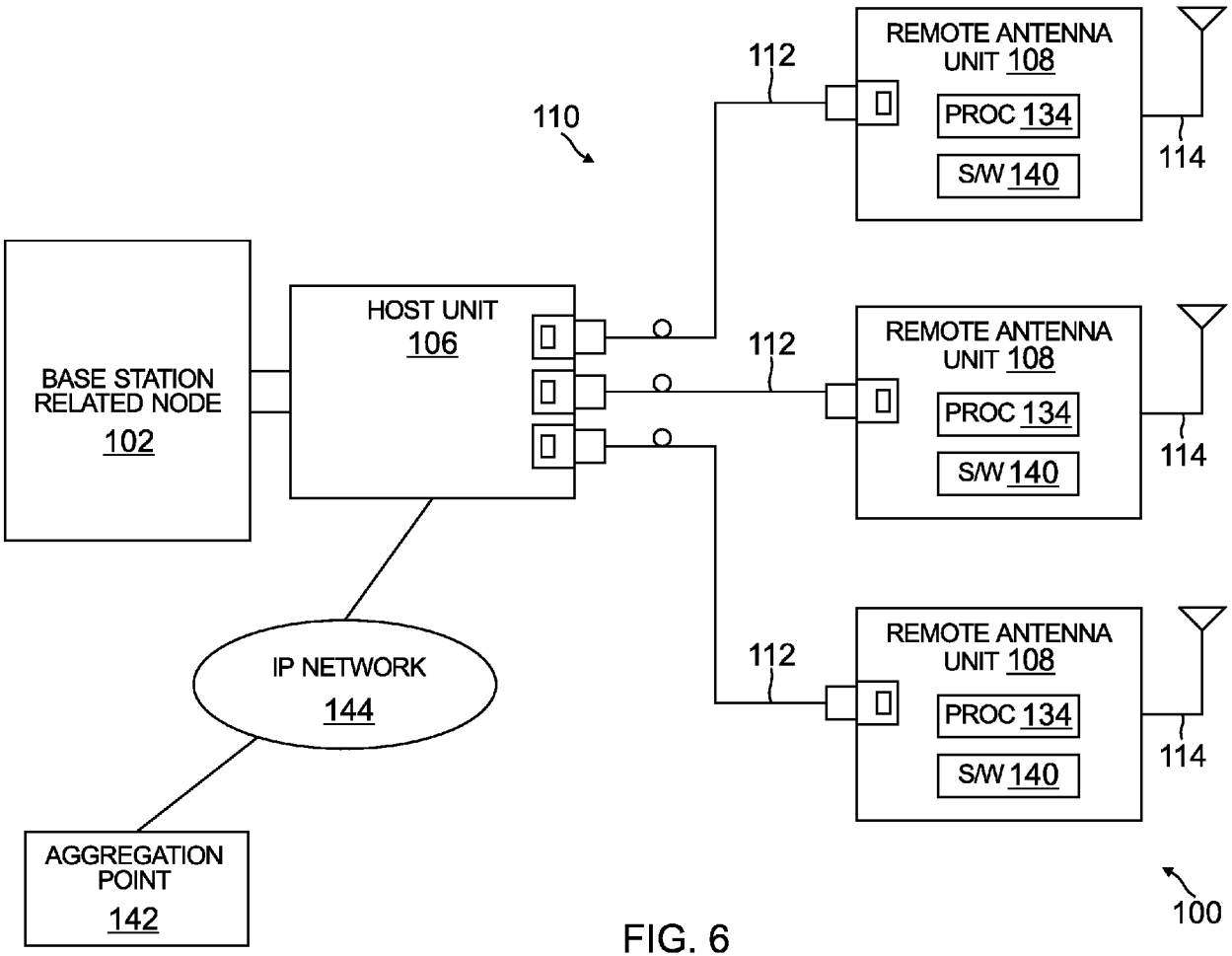
FIG. 6 is a block diagram of an example of a distributed antenna system (DAS) in which the system of FIG. 1 can be used.

FIG. 6 is a block diagram of one exemplary embodiment of a distributed antenna system (DAS) 100 in which a system 1 of FIG. 1 can be used. A DAS 100 is used to improve the coverage provided by a given base station or group of base stations by using a distributed antenna system (DAS). In a DAS, radio frequency (RF) signals are communicated between a host unit and one or more remote units (RUs). The host unit can be communicatively coupled to one or more base stations directly by connecting the host unit to the base station using, for example, coaxial cabling. The host unit can also be communicatively coupled to one or more base stations wirelessly, for example, using a donor antenna and a bi-directional amplifier (BDA).

RF signals transmitted from the base station (also referred to here as "downlink RF signals") are received at the host unit. The host unit uses the downlink RF signals to generate a downlink transport signal that is distributed to one or more of the RUs. Each such RU receives the downlink transport signal and reconstructs the downlink RF signals based on the downlink transport signal and causes the reconstructed downlink RF signals to be radiated from at least one antenna coupled to or included in that RU. A similar process is performed in the uplink direction. RF signals transmitted from mobile units (also referred to here as "uplink RF signals") are received at each RU. Each RU uses the uplink RF signals to generate an uplink transport signal that is transmitted from the RU to the host unit. The host unit receives and combines the uplink transport signals transmitted from the RUs. The host unit reconstructs the uplink RF signals received at the RUs and communicates the reconstructed uplink RF signals to the base station. In this way, the coverage of the base station can be expanded using the DAS.

One or more intermediate devices (also referred to here as "expansion hubs" or "expansion units") can be placed between the host unit and the remote units in order to increase the number of RUs that a single host unit can feed and/or to increase the host-unit-to-RU distance.

Typically, the host unit, the RUs, and any intermediary devices are designed to use proprietary protocols for communications that occur within the DAS. As a result, the host unit, the RUs, and the intermediary devices are typically sold by the same original equipment manufacture. However, a conventional DAS network typically does not include any mechanism to ensure that only authorized RUs are used in a given DAS network.

One type of DAS is a so-called digital DAS. In one common digital DAS configuration, a host unit digitizes analog downlink RF signals received from one or more base stations (either directly or via a donor antenna and BDA). The digital data that results from digitizing each of the base station inputs is framed together and communicated over one or more fibers to multiple RUs, where each RU converts the digital data back to downstream analog RF signals for radiation from antennas associated with each RU. Similar processing is performed in the upstream direction. Upstream analog RF signals received on the antenna coupled to each RU are digitized, and the resulting digital data is framed together and communicated over a fiber to the host unit. The host unit receives the upstream digital data and converts the digital data back to upstream analog RF signals that can be provided to a base station for processing thereby.

Typically, such a digital DAS is implemented in a point-to-multipoint topology, where the host unit is coupled to each RU over a respective pair of optical fibers.

In the example shown in FIG. 6, DAS 100 is used to distribute bi-directional wireless communications between one or more base station-related nodes 102 and one or more wireless devices (for example, mobile telephones, mobile computers, and/or combinations thereof such as personal digital assistants (PDAs) and smartphones). In the exemplary embodiment shown in FIG. 6, the DAS 100 is used to distribute a plurality of bi-directional radio frequency bands. Also, each such radio frequency band is typically used to communicate multiple logical bi-directional RF channels.

DAS 100 can be configured to distribute wireless communications that use licensed radio frequency spectrum, such as cellular radio frequency communications. Examples of such cellular RF communications include cellular communications that support one or more of the second generation (2G), third generation (3G), and fourth generation (4G) Global System for Mobile communication (GSM) family of telephony and data specifications and standards, one or more of the second generation (2G), third generation (3G), and fourth generation (4G) Code Division Multiple Access (CDMA) family of telephony and data specifications and standards, and/or the WIMAX family of specification and standards. DAS 100 can also be configured to distribute wireless communications that make use of unlicensed radio frequency spectrum such as wireless local area networking communications that support one or more of the IEEE 802.11 family of standards. The DAS technology described here can be used to distribute combinations of licensed and unlicensed radio frequency spectrum in the using the same DAS.

In one exemplary implementation of the example DAS 100 shown in FIG. 6, the DAS is configured to distribute wireless communications that use frequency division duplexing in to order to support bi-directional communications. In such an implementation, each bi-directional radio frequency band distributed by the DAS 100 includes a separate radio frequency band for each of two directions of communications. One direction of communication is from the base station-related node 102 to a wireless device and is referred to here as the "downstream" or "downlink" direction. The other direction of communication is from the wireless device to the base station-related node 102 and is referred to here as the "upstream" or "uplink" direction. Each of the distributed bi-directional radio frequency bands includes a respective "downstream" band in which downstream RF channels are communicated for that bi-directional radio frequency band and an "upstream" band in which upstream RF channels are communicated for that bi-directional radio frequency band. The downstream and upstream bands for a given bi-directional radio frequency band need not be, and typically are not, contiguous. To support frequency division duplexing, the DAS 100 is configured to process and distribute the upstream and downstream signals separately.

In other embodiments, the DAS 100 is configured to communicate at least some wireless communications that use other duplexing techniques (such as time division duplexing, which is used, for example, in some WIMAX implementations). For example, in one exemplary implementation, the DAS is configured to distribute wireless communications that use time division duplexing in to order to support bi-directional communications. In such an implementation, each bi-directional radio frequency band distributed by the DAS 100 uses the same frequency band for both downstream and upstream communications. In such an implementation, the various nodes in the DAS 100 include switching functionality to switch between communicating in the downstream direction and the communicating in the upstream direction as well as functionality for synchronizing such switching with the time division duplexing scheme used by the RF communications that are being distributed. Examples of schemes for implementing such time division duplexing are described in the following United States patent applications, all of which are incorporated herein by reference: U.S. patent application Ser. No. 09/771,320, filed Jan. 26, 2001, and titled "METHOD AND SYSTEM FOR DISTRIBUTED MULTIBAND WIRELESS COMMUNICATION SIGNALS", issued as U.S. Pat. No. 6,801,767; U.S. patent application Ser. No. 12/144,961, filed Jun. 24, 2008, and titled "METHOD AND APPARATUS FOR FRAME DETECTION IN A COMMUNICATIONS SYSTEM"; U.S. patent application Ser. No. 12/144,939, filed Jun. 24, 2008, and titled "SYSTEM AND METHOD FOR SYNCHRONIZED TIME-DIVISION DUPLEX SIGNAL SWITCHING"; U.S. patent application Ser. No. 12/144,913, filed Jun. 24, 2008, titled "SYSTEM AND METHOD FOR CONFIGURABLE TIME-DIVISION DUPLEX INTERFACE", issued as U.S. Pat. No. 8,208,414.

In the exemplary embodiment shown in FIG. 6, the DAS 100 includes a host unit 106 and one or more remote units 108 that are located remotely from the host unit 106. The DAS 100 shown in FIG. 6 uses one host unit 106 and three remote units 108, though it is to be understood that other numbers of host units 106 and/or remote units 108 can be used.

In the example shown in FIG. 6, the host unit 106 is communicatively coupled to one or more base station-related nodes 102 either directly (for example, via one or more coaxial cable connections) or indirectly (for example, via one or more donor antennas and one or more bidirectional amplifiers). In one implementation of the embodiment shown in FIG. 6, the host unit 106 is communicatively coupled to one or more base stations that transmit and receive radio frequency wireless communications (that is, the base station-related node 102 comprises one or more base stations). In such an implementation, the output of the one or more base stations may need to attenuated or otherwise conditioned before being input to the host unit 106.

In another implementation of such an embodiment, the host unit 106 includes functionality that implements one or more functions that historically have been performed by a traditional base station (for example, base band processing) and, in such an implementation, the host unit 106 is communicatively coupled to one or more radio network controllers, base station controllers, or similar nodes (for example, using an Internet Protocol (IP) network and/or one or more traditional TDM links (for example, one or more T1 or E1 connections)).

In the exemplary embodiment shown in FIG. 6, the host unit 106 is communicatively coupled to each remote units 108 over transport communication media 110. The transport communication media 110 can be implemented in various ways. For example, the transport communication media can be implemented using respective separate point-to-point communication links, for example, where respective optical fiber or copper cabling is used to directly connect the host unit 106 to each remote unit 108. One such example is shown in FIG. 6, where the host unit 106 is directly connected to each remote unit 108 using a respective optical fiber 112. Also, in the embodiment shown in FIG. 6, a single optical fiber 112 is used to connect the host unit 106 to each remote unit 108, where wave division multiplexing (WDM) is used to communicate both downstream and upstream signals over the single optical fiber 112. In other embodiments, the host unit 106 is directly connected to each remote unit 108 using more than one optical fiber (for example, using two optical fibers, where one optical fiber is used for communicating downstream signals and the other optical fiber is used for communicating upstream signals). Also, in other embodiments, the host unit 106 is directly connected to one or more of the remote units 108 using other types of communication media such a coaxial cabling (for example, RG6, RG11, or RG59 coaxial cabling), twisted-pair cabling (for example, CAT-5 or CAT-6 cabling), or wireless communications (for example, microwave or free-space optical communications).

The transport communication media 110 can also be implemented using shared point-to-multipoint communication media in addition to or instead of using point-to-point communication media. One example of such an implementation is where the host unit 106 is directly coupled to an intermediary unit (also sometimes referred to as an "expansion" unit), which in turn is directly coupled to multiple remote units 108. One example of such a DAS is, where the host unit 106 is directly connected to an expansion unit 116 using a pair of optical fibers 118 (one fiber being used for downstream communications and the other fiber being used for upstream communications) and where the expansion hub 116, in turn, is directly connected to the multiple remote units 108 using respective coaxial cables 120 (over which both downstream and upstream signals are communicated). Another example of a shared transport implementation is where the host unit 106 is coupled to the remote units using an Internet Protocol (IP) network.

Each remote unit 108 includes or is coupled to at least one antenna 114 via which the remote unit 108 receives and radiates radio frequency signals (as described in more detail below). Various antenna configurations can be used. For example, a single antenna 114 can be used for transmitting and receiving all of the frequency bands handled by given remote unit 108. Also, different antennas 114 can be used for transmitting and receiving and/or different antennas 114 can be used for the various frequency bands handled by a given remote unit 108. Other antenna configurations can be used (for example diversity transmit and receive configurations or Multiple-Input-Multiple-Output (MIMO) configurations).

Referring also to system 1 of FIG. 1, the transceiver unit 10 of system 1 can comprise a remote unit 108 of DAS 100. Additionally, the antenna units 12, 13, 14 of system 1 can comprise antennas 114 of DAS 100. Although FIG. 6 illustrates only a single antenna 114 (i.e., antenna unit 12, 13, 14), multiple antennas 114 can be coupled to a single remote unit 108 as shown in FIG. 1.

In general, the host unit 106 receives one or more downstream signals from the base station-related nodes 102 and generates one or more downstream transport signals from the received downstream signals (or from signals or data derived therefrom). The host unit 106 then transmits the downstream transport signals to the remote units 108 via the transport media 110 (and any intermediary devices that are located between the host unit 106 and each remote unit 108). Each remote unit 108 receives at least one downstream transport signal. Each remote unit 108 generates one or more downstream radio frequency signals using, at least in part, the received at least one downstream transport signal (or from signals or data derived therefrom) and causes the one or more downstream radio frequency signals to be radiated from the one or more remote antennas 114 coupled to or included in that remote unit 108.

A similar process is performed in the upstream direction. Upstream radio frequency signals are received at one or more remote units 108 via the antennas 114. At each remote unit 108, the remote unit 108 uses the received upstream radio frequency signals to generate respective upstream transport signals that are transmitted from the respective remote units 108 to the host unit 106. The host unit 106 receives the upstream transport signals transmitted from the remote units 108. The host unit 106 generates one or more upstream signals for communicating to one or more of the base station-related nodes 102 from one or more of the received upstream transport signals (or from signals or data derived therefrom). In connection with generating the upstream signals for the base station-related nodes 102, the host unit 106 may combine signals or data received from multiple remote units 108.

In implementations where the base station-related nodes 102 comprises base stations, the downstream signals received at the host unit 106 comprise downstream radio frequency signals and the upstream signals generated by the host unit 106 for communicating to the base stations comprise upstream radio frequency signals.

In such implementations, the DAS 100 can be implemented as a digital DAS 100 in which the downstream radio frequency signals received at the host unit 106 are digitized by the host unit 106 (for example, by down converting the received downstream radio frequency signals to an intermediate frequency and then digitizing the resulting intermediate frequency signals). The digitized downstream radio frequency data is included in the downstream transport signals that are communicated to the remote units 108. The remote units 108 then use the digitized downstream radio frequency data to generate the downstream radio frequency signals (for example, by performing a digital-to-analog (D/A) conversion on the digitized downstream radio frequency data, up converting the resulting analog signal to an appropriate radio frequency band, and filtering and amplifying the resulting downstream radio frequency signals).

In such a digital DAS example, in the upstream direction, upstream radio frequency signals received at the remote units 108 are digitized by the remote units 108 (for example, by down converting the received upstream radio frequency signals to an intermediate frequency and then digitizing the resulting intermediate frequency signals). The digitized upstream radio frequency data is included in the upstream transport signals that are communicated from the remote units 108 to the host unit 106. The host unit 106 then uses the digitized upstream radio frequency data to generate the upstream radio frequency signals for communicating to the base stations (for example, by performing a digital-to-analog (D/A) conversion on the digitized upstream radio frequency data, up converting the resulting signals to an appropriate radio frequency band, and filtering and amplifying the resulting upstream radio frequency signals). The host unit 106 can combine data or signals received from multiple remote units 108.

The DAS 100 can also be implemented as an analog DAS 100 in which the downstream and upstream transport signals comprise analog versions of the downstream radio frequency signals received at the host unit 106 and the upstream radio frequency signals received at the remote units 108, respectively. The downstream and upstream transport signals can include frequency shifted or non-frequency shifted versions of the downstream radio frequency signals and the upstream radio frequency signals, respectively.

In one example of a frequency shifting analog DAS 100, the downstream radio frequency signals received at the host unit 106 are frequency shifted by the host unit 106 (for example, by down converting the received downstream radio frequency signals to an intermediate frequency). The frequency shifted downstream signals are included in the downstream transport signals that are communicated to the remote units 108. The remote units 108 use the frequency shifted downstream signals to generate the downstream radio frequency signals (for example, by up converting the frequency shifted signals to an appropriate radio frequency band, and filtering and amplifying the resulting downstream radio frequency signals).

In such a frequency shifting analog DAS example, in the upstream direction, upstream radio frequency signals received at the remote units 108 are frequency shifted by the remote units 108 (for example, by down converting the received upstream radio frequency signals to an intermediate frequency). The frequency shifted upstream signals are included in the upstream transport signals that are communicated from the remote units 108 to the host unit 106. The host unit 106 uses the frequency shifted upstream signals to generate the upstream radio frequency signals for communicating to the base stations (for example, by up converting the frequency shifted signals to an appropriate radio frequency band, and filtering and amplifying the resulting upstream radio frequency signals). The host unit 106 can combine data or signals received from multiple remote units 108.

In implementations where the host unit 106 comprises one or more functions that have traditionally been implemented by a base station (for example, where the host unit 106 includes a small base station or base band module), the downstream signals received at the host unit 106 comprise downstream signals that include the payload, signaling, control, and/or other data needed by such functions. For example, these downstream signals can be used by the functionality in the host unit 106 to generate digital downstream baseband data, which is included in the downstream transport signals that are communicated to the remote units 108. The remote units 108 use the downstream baseband data to generate the downstream radio frequency signals (for example, by performing a digital-to-analog (D/A) conversion on the received baseband data, up converting the resulting signals to appropriate radio frequency bands, and filtering and amplifying the resulting downstream radio frequency signals).

In such an example, in the upstream direction, the remote units 108 generate digital baseband data from the upstream radio frequency signals received via the antennas 114 (for example, by filtering, attenuating, and/or amplifying the received upstream radio frequency signals, down converting the conditioned upstream radio frequency signals, and performing an analog-to-digital (A/D) conversion on the resulting down converted signals). The upstream baseband data is included in the upstream transport signals that are communicated from the remote units 108 to the host unit 106. The functionality in the host unit 106 uses the received upstream baseband data for the baseband or other processing performed in the host unit 106. The host unit 106 can combine data or signals received from multiple remote units 108.

Also, DAS 100 can be implemented using combinations of any of the aforementioned types of DAS architectures.

In some implementations, the DAS 100 is configured as a "base station hotel" or "neutral host" in which multiple wireless service providers share a single DAS 100.

In one example, the remote units 108 are configured to communicate information regarding antenna units 114 (i.e., antenna units 12, 13, 14) to an aggregation point 142. The programmable processor 134 (i.e., processor 24 of transceiver unit 10) that is included in each remote unit 108 is configured to execute software 140 that carries out various functions performed by the remote unit 108. The software 140 comprises program instructions that are stored (or otherwise embodied) on or in an appropriate non-transitory storage medium or media (such as flash or other non-volatile memory, magnetic disc drives, and/or optical disc drives) from which at least a portion of the program instructions are read by the programmable processor 134. The storage media can be included in, and local to, the remote unit 108, or remote storage media (for example, storage media that is accessible over the network) and/or removable media can also be used. The remote unit 108 also include memory for storing the program instructions (and any related data) during execution by the programmable processor 134. The memory comprises, in one implementation, any suitable form of random access memory (RAM) now known or later developed, such as dynamic random access memory (DRAM). In other embodiments, other types of memory are used.

The software 140 can be configured to communicate at least some of the information regarding antenna units 114 (also referred to herein as PLM information) to an aggregation point 142. The information regarding antenna units 114 (i.e., antenna units 12, 13, 14) can include information read from a non-volatile memory 26, 27, 28 associated with an antenna unit 12, 13, 14 (e.g., ID information, attribute information) and/or can include information regarding whether or not an antenna unit 12, 13, 14 is coupled to a remote unit 108. For example, such antenna information can include information indicating that an antenna unit 12, 13, 14 has been de-coupled from a remote unit 108.

In this example, the aggregation point 142 is communicatively coupled to each node in the DAS 100, either directly or indirectly, via an IP network 144. An out-of-band management or control channel that is provided between the host unit 106 and each remote unit 108 can be used for communicating the PLM information obtained by the remote unit 108 to the aggregation point 142 via a connection to the IP network 144 made by the host unit 106. The PLM information obtained by each remote unit 108 can be communicated to the aggregation point 142 in other ways.

The aggregation point 142 is implemented as middleware software executing on one or more servers (or other computers). The aggregation point 142 aggregates information from various entities within a network. The information that is aggregated by the aggregation point 142 includes information that is automatically captured by entities that include functionality for reading PLM components that are integrated into connectors. Such automatically captured information includes information about the identity, type, and length of cable used, information about the identity and type of connector used, and information that associates each such connector (and/or cable) with a respective jack, port, information regarding the antenna units 12, 13, 14, or other attachment point of the relevant entity.

The information that is aggregated by the aggregation point 142 also includes information that is manually entered. Examples of such manually entered information include information about the horizontal runs (including information about the identity, type, length, and location of cabling used), information about the wall plate devices that terminate the various horizontal runs (including information about the identity, type, location, and capabilities of the wall plate device), information about switches or other networking devices (including information about the identity, type, location, and capabilities of the switches or other networking devices), and information that associates each such connector (and/or cable) with a respective jack, port, or other attachment point of the relevant entity. Other types of information that can be aggregated by the aggregation point 142 are described in the patent applications listed here.

The aggregation point 142 can implement an application programming interface (API) by which application-layer functionality can gain access to the physical layer information maintained by the aggregation point 142 using a software development kit (SDK) that describes and documents the API. In this way, applications that make use of such PLM information can be developed without requiring those applications to directly interact with the individual devices in the network.

One function that can be performed by the aggregation point 142 is associating various entities within the network with other entities within the network. The lower-level associations provided to the aggregation point 142 (either manually or automatically) are used to construct a set of associations that identifies a physical communication path through the devices for which the aggregation point 142 has information. For example, the aggregation point 142 can be used to construct a set of associations that identifies a physical communication path between the host unit 106 and each remote unit 108.

In some examples, the units in the DAS 100 (e.g., the remote units 108, the host unit 106 and any expansion hub) can also incorporate PLM technology to read PLM information from the cabling attached to those units and to communicate such information to the aggregation point 142. Moreover, PLM information captured from other devices in the network (for example, patch panels, inter-networking devices (such switches, routers, hubs, gateways), optical distribution frames, etc.) can be captured and communicated to aggregation point 142 for use in connection with the authentication processing described here and/or for other purposes (for example, general physical layer management and network management).

A number of embodiments have been described. Nevertheless, it will be understood that various modifications to the described embodiments may be made without departing from the spirit and scope of the claimed invention. Also, combinations of the individual features of the above-described embodiments are considered within the scope of the inventions disclosed here.

Example Embodiments

Example 1 includes an antenna unit comprising: an antenna; a coax connector configured to connect to a coaxial cable, the coax connector including an inner conductor configured to contact a signal conductor of a coaxial cable connected thereto and a ground contact configured to contact a metal shield of the coaxial cable connected thereto, the coax connector coupled to the antenna such that RF signals on the inner conductor are coupled to the antenna and radiated therefrom and such that RF signals sensed by the antenna are coupled to the inner conductor; and a non-volatile memory coupled to the coax connector such that the non-volatile memory can send and receive signals over the inner conductor, the non-volatile memory configured to obtain operating power from a direct current voltage provided over a coaxial cable connected to the coax connector, wherein the non-volatile memory has an identifier stored therein for identifying the antenna unit and is configured to send the identifier over the inner conductor in response to a read request received over the inner conductor.

Example 2 includes the antenna unit of Example 1, wherein the non-volatile memory is configured to communicate over the inner conductor using a digital signal having a frequency significantly lower than a radio frequency used for signals over the antenna.

Example 3 includes the antenna unit of any of Examples 1-2, wherein the non-volatile memory has a one-wire interface that is coupled to the inner conductor, the non-volatile memory configured to send the identifier from the one-wire interface in response to a read request received at the one-wire interface, the non-volatile memory configured to obtain operating power from the inner conductor.

Example 4 includes the antenna unit of any of Examples 2-3, comprising: a capacitor coupled between a ground connection of the antenna and ground; wherein the one-wire interface of the non-volatile memory is coupled to the ground connection of the antenna and a ground contact of the non-volatile memory is coupled to ground.

Example 5 includes the antenna unit of Example 4, comprising: a resistor coupled in series between the ground connection of the antenna and the one-wire interface of the non-volatile memory.

Example 6 includes the antenna unit of any of Examples 4-5, comprising: an RF filter coupled in series between the inner conductor of the coax connector and the one-wire interface of the non-volatile memory.

Example 7 includes the antenna unit of any of Examples 2-6, comprising: wherein the one-wire interface of the non-volatile memory is coupled to the RF path between the inner conductor of the coaxial connector and the antenna.

Example 8 includes the antenna unit of any of Examples 1-7, wherein the non-volatile memory includes an erasable programmable read only memory (EPROM).

Example 9 includes the antenna unit of any of Examples 1-8, wherein the non-volatile memory includes attribute information corresponding to the antenna.

Example 10 includes the antenna unit of any of Examples 1-9, wherein the attribute information includes one or more of a location of the antenna, a type of the antenna, and a frequency band for the antenna.

Example 11 includes a method of identifying an antenna, the method comprising: sending and receiving radio frequency (RF) signals at a transceiver unit, the RF signals coupled over a coaxial cable between the transceiver unit and an antenna at which the RF signals are radiated or sensed; coupling a direct current (DC) voltage onto the coaxial cable; powering a non-volatile memory from the DC voltage over the coaxial cable, the non-volatile memory coupled to the coaxial cable and co-located with the antenna; sending a read request from the transceiver unit over the coaxial cable to the non-volatile memory; receiving the read request at the non-volatile memory; sending a response to the read request from the non-volatile memory over the coaxial cable, wherein the non-volatile memory has an identifier stored therein for identifying the antenna and wherein non-volatile memory includes the identifier in the response; and receiving the response at the transceiver unit, the response identifying the antenna to the transceiver unit.

Example 12 includes the method of Example 11, wherein the read request is sent via a digital signal having a frequency that is significantly lower than a frequency of the RF signal.

Example 13 includes the method of any of Examples 11-12, wherein receiving the read request at a non-volatile memory includes receiving the read request at a one-wire interface of the non-volatile memory; and wherein sending a response includes sending a response from the one-wire interface.

Example 14 includes the method of any of Examples 11-13, comprising: blocking the DC signal from reaching a ground connection of the non-volatile memory.

Example 15 includes the method of any of Examples 11-14, comprising: bypassing the RF signals past the non-volatile memory as the RF signals propagate between the antenna and the transceiver unit.

Example 16 includes the method of any of Examples 11-15, comprising: filtering the RF signals before an input into the non-volatile memory.

Example 17 includes the method of any of Examples 11-16, wherein the transceiver unit includes an RF transceiver configured to send and receive the radio frequency (RF) signals and an antenna identifying circuit configured to send the read request and receive the response.

Example 18 includes the method of Example 17, comprising: sending a request for attribute information from the antenna identifying circuit of the transceiver unit to the non-volatile memory; receiving the request for attribute information at the non-volatile memory; and sending a response including the attribute information from the non-volatile memory to the transceiver unit, the attribute information corresponding to the antenna.

Example 19 includes the method of any of Examples 17-18, comprising: sending a write request from the antenna identifying circuit of the transceiver unit to the non-volatile memory, the write request including information to write to the non-volatile memory; receiving the write request at the non-volatile memory; and storing the informing in the write request in the non-volatile memory.

Example 20 includes an in-line antenna identifying device comprising: a first coax connector configured to connect to a coaxial cable, the first coax connector including an inner conductor configured to contact a signal conductor of a coaxial cable connected thereto and a ground contact configured to contact a metal shield of the coaxial cable connected thereto; a second coax connector configured to connect to a coaxial cable, the second coax connector including an inner conductor configured to contact a signal conductor of a coaxial cable connected thereto and a ground contact configured to contact a metal shield of the coaxial cable connected thereto, wherein radio frequency (RF) signals received on either of the inner conductors are coupled to the other of the inner conductors; and a non-volatile memory coupled to the first coax connector such that the non-volatile memory can send and receive signals over the inner conductor of the first coax connector, the non-volatile memory configured to obtain operating power from a direct current voltage provided over a coaxial cable connected to the first coax connector, wherein the non-volatile memory has an identifier stored therein for identifying an antenna coupled to the second coax connector and is configured to send the identifier over the inner conductor in response to a read request received over the inner conductor.

Example 21 includes the in-line antenna identifying device of Example 20, wherein the non-volatile memory is configured to communicate over the inner conductor of the first coax connector using a digital signal having a frequency significantly lower than a radio frequency used for the RF signals coupled from either of the inner conductors to the other inner conductor.

Example 22 includes the in-line antenna identifying device of Example 21, wherein the non-volatile memory has a one-wire serial interface coupled to the inner conductor of the first coax connector and a ground contact coupled to the inner conductor of the second coax connector, such that the non-volatile memory is grounded when a grounded antenna is coupled to the second coax connector thereby coupling a ground to the inner conductor of the second coax connector.

Example 23 includes the in-line antenna identifying device of Example 22, comprising: a capacitor in series between the first coax connector and the second coax connector such that a first end of the capacitor is coupled to the inner conductor of the first coax connector and the second end of the capacitor is coupled to the inner conductor of the second coax connector, wherein the one-wire serial interface of the non-volatile memory is coupled to the first end of the capacitor and the ground contact of the non-volatile memory is coupled to the second end of the capacitor.

Example 24 includes the in-line antenna identifying device of any of Examples 22-23, wherein the non-volatile memory is configured to send the identifier from the one-wire serial interface in response to a read request received at the one-wire serial interface, and wherein the non-volatile memory is configured to obtain operating power from the inner conductor of the first coax connector.

Example 25 includes the in-line antenna identifying device of any of Examples 20-24, wherein the non-volatile memory includes an erasable programmable read only memory (EPROM).

Example 26 includes the in-line antenna identifying device of any of Examples 20-25, wherein the non-volatile memory includes attribute information corresponding to the antenna.

Example 27 includes the antenna unit of Example 26, wherein the attribute information includes one or more of a location of the antenna, a type of the antenna, and a frequency band for the antenna.

Example 28 includes a transceiver unit comprising: a radio frequency (RF) transceiver coupled to a coax connector and configured to send and receive RF signals over an inner conductor of the coax connector; a processing device coupled to the inner conductor of the coax connector, the processing device configured to send a read request over the inner conductor to one or more non-volatile memory, and to receive respective responses from the one or more non-volatile memory identifying one or more antennas that are coupled to the coax connector; and a direct current (DC) voltage coupled to the inner conductor to power the one or more non-volatile memory devices.

Example 29 includes the transceiver unit of Example 28, comprising: a first capacitor coupled in series between the RF transceiver and the inner conductor of the coax connector; an inductor coupled on a first end to the inner conductor of the coax connector, between the first capacitor and the coax connector and on a second end to the processing device; and a second capacitor coupled on a first end to the second end of the inductor and on a second end to ground.

Example 30 includes the transceiver unit of any of Examples 28-29, wherein the (DC) voltage is coupled to the inner conductor by a resistive device coupled between a DC rail and the second end of the inductor.

Example 31 includes the transceiver unit of any of Examples 28-30, wherein the transceiver unit is a remote unit in a distributed antenna system (DAS) and is configured to communicate with a host unit and to transmit and receive signals over one or more antennas coupled to the remote unit.

Example 32 includes the transceiver unit of Example 31, wherein the processing device is configured to receive a request to identify antennas coupled thereto from the host unit and to send the read request in response thereto, wherein the processing device is configured to send information identifying the one or more antennas to the host unit.

Example 33 includes the transceiver unit of any of Examples 28-32, wherein the processing device is configured to: send a request for attribute information over the inner conductor to a non-volatile memory of the one or more non-volatile memory; and receive a response including the attribute information, the attribute information corresponding to the antenna of the one or more antennas associated with the one of the non-volatile memory.

Example 34 includes the transceiver unit of Example 33, wherein the processing device is configured to: send a write request over the inner conductor to the non-volatile memory, the write request including information to write to the non-volatile memory.

Example 35 includes a system for transmitting and receiving radio frequency (RF) signals at one or more antennas, the system comprising: a transceiver unit coupled to a first coaxial cable and configured to send and receive the RF signals over a signal conductor of the first coaxial cable; a first antenna coupled to the first coaxial cable or a coaxial cable in series between the first antenna and the first coaxial cable; and a first non-volatile memory co-located with the first antenna and coupled to the first coaxial cable or the coaxial cable in series between the first antenna and the first coaxial cable such that the first non-volatile memory can send and receive signals over the first coaxial cable, the first non-volatile memory configured to obtain operating power from a direct current (DC) voltage provided over the first coaxial cable; wherein the transceiver unit includes an antenna identifying circuit configured to send a read request over the first coaxial cable to the first non-volatile memory; and wherein the first non-volatile memory has an identifier stored therein for identifying the first antenna and is configured to send the identifier over the first coaxial cable in response to the read request received over the first coaxial cable.

Example 36 includes the system of Example 35, comprising: one or more second antennas, each second antenna coupled to a respective coaxial cable in series between the respective second antenna and the first coaxial cable; one or more second non-volatile memories, each second non-volatile memory co-located with a respective second antenna, each second non-volatile memory coupled to the respective coaxial cable that is coupled to the respective co-located second antenna such that each second non-volatile memory can send and receive signals over the respective coaxial cable, each second non-volatile memory configured to obtain operating power from the DC voltage provided over the first coaxial cable, each second non-volatile memory having a respective identifier stored therein for identifying the respective co-located second antenna, each second non-volatile memory configured to send the respective identifier over the respective coaxial cable in response to a read request received over the respective coaxial cable.

Example 37 includes the system of Example 36, wherein the transceiver unit is configured to send a generic read request over the first coaxial cable, the generic read request configured to cause any antenna identifying non-volatile memories coupled to the first coaxial cable or a coaxial cable in series with the first coaxial cable to respond with their respective identifier.

Example 38 includes the system of any of Examples 36-37, wherein the first antenna is coupled to the coaxial cable in series between the first antenna and the first coaxial cable, the system comprising: a splitter/combiner coupled to the first coaxial cable and a plurality of coaxial cables in series between the first coaxial cable and respective antennas of a plurality of antennas, wherein the plurality of antennas includes the first antenna and the one or more second antennas and wherein the plurality of coaxial cables include the coaxial cable in series between the first antenna and the first coaxial cable and the respective antennas between the respective second antennas and the first coaxial cable, the splitter/combiner configured to split and combine RF signals between the first coaxial cable and a plurality of coaxial cables, wherein the splitter/combiner is configured to pass the DC voltage from the first coaxial cable to the plurality of coaxial cables and is configured to couple a read request on the first coaxial cable to the plurality of coaxial cables and is configured to couple a response on any of the plurality of coaxial cables to the first coaxial cable.

Example 39 includes the system of Example 38, wherein the first non-volatile memory is integrated in a device with the first antenna.

Example 40 includes the system of any of Examples 38-39, wherein the first non-volatile memory is an in-line device separate from the first antenna and is configured to be coupled between the first antenna and the coaxial cable in series between the first coaxial cable and the first antenna.

Example 41 includes the system of any of Examples 35-40, wherein the transceiver unit is configured to couple the DC voltage to the first coaxial cable.

Example 42 includes the system of any of Examples 35-41, comprising: a host unit for a digital antenna system (DAS); and wherein the transceiver unit is located remotely from the host unit and is communicatively coupled to the host unit, wherein the host unit is configured to communicate a downstream transport signal from the host unit to the transceiver unit; wherein the transceiver unit is configured to use the downstream transport signal to generate a downstream RF signal to send over the first coaxial cable for radiation from the first antenna.

Example 43 includes the system of Example 42, wherein the transceiver unit is configured to generate an upstream transport signal from an upstream RF signal received via the first antenna; wherein the transceiver unit is configured to communicate the upstream transport signal from the transceiver unit to the host unit; and wherein the host unit is configured to use the upstream transport signal to generate a upstream signal that is provided by the host unit to at least one base-station related node.

Example 44 includes the system of Example 43, wherein the transceiver unit is configured to generate the upstream transport signal by doing at least one of: down-converting a signal derived from the upstream radio frequency signal; and performing an analog-to-digital conversion (A/D) process on a signal derived from the upstream radio frequency signal.

Example 45 includes the system of Example 44, wherein the host unit is configured to do at least one of the following in connection with generating the upstream signal from the upstream transport signal: performing a digital-to-analog conversion on a signal derived from the upstream transport signal; and upconverting a signal derived from the upstream transport signal.

Example 46 includes the system of any of Examples 42-45, wherein the host unit is coupled to a base-station related node.

Example 47 includes the system of Example 46, wherein the base-station related node comprises at least one of a base station, a radio access controller, and a base station controller.

Example 48 includes the system of any of Examples 42-47, wherein the host unit is configured to receive downstream RF signal from a base station and to generate the downstream transport signal from the downstream radio frequency signal.

Example 49 includes the system of any of Examples 42-48, wherein the host unit is configured to receive digital downstream baseband data from a base station related node and to generate the downstream transport signal from the digital downstream baseband data.

Example 50 includes the system of any of Examples 42-49, wherein DAS comprises at least one of an analog DAS and a digital DAS.

Example 51 includes the system of any of Examples 42-50, wherein the host unit is configured to generate the downstream transport signal by doing at least one of: generating digital downstream baseband data using a base band module or a base station module included in the host unit; performing an analog-to-digital conversion on a signal derived from the downstream signal; and frequency shifting a signal derived from the downstream signal.

Example 52 includes the system of any of Examples 42-51, wherein the transceiver unit is configured to do at least one of the following in connection with generating the downstream RF signal from the downstream transport signal: performing a digital-to-analog conversion on a signal derived from the downstream transport signal; up-converting a signal derived from the downstream transport signal; filtering a signal derived from the downstream transport signal; and amplifying a signal derived from the downstream transport signal.

Example 53 includes the system of any of Examples 42-52, wherein the host unit is configured to send a request to the transceiver unit, the request to identify antennas coupled to the transceiver unit; and wherein the transceiver unit is configured to send the read request in response to the request to identify antennas, wherein the transceiver unit is configured to provide the identifier for the first antenna to the host unit.

Example 54 includes the system of any of Examples 42-53, wherein the transceiver unit is configured to send a request for attribute information from the antenna identifying circuit to the non-volatile memory; wherein the first non-volatile memory is configured to receive the request for attribute information and send a response including the attribute information to the transceiver unit, the attribute information corresponding to the first antenna.

Example 55 includes the system of Example 54, wherein the transceiver unit is configured to send a write request from the antenna identifying circuit to the first non-volatile memory, the write request including information to write to the first non-volatile memory; wherein the first non-volatile memory is configured to store the informing in the write request in the non-volatile memory.

What is claimed is:

1. A method of identifying an antenna, the method comprising:

coupling radio frequency (RF) signals between a transceiver unit and an antenna over first and second sections of a coaxial cable coupled between the transceiver unit and the antenna;

coupling a direct current (DC) voltage onto the first section of the coaxial cable and across a capacitor coupled between the first and second sections of the coaxial cable;

powering a non-volatile memory coupled across the capacitor from the DC voltage;

sending a read request from the transceiver unit over the coaxial cable to the non-volatile memory;

receiving the read request at the non-volatile memory;

sending a response to the read request from the non-volatile memory over the coaxial cable, wherein the non-volatile memory has an identifier stored therein for identifying the antenna and wherein the non-volatile memory includes the identifier in the response; and receiving the response at the transceiver unit, the response identifying the antenna to the transceiver unit.

2. The method of claim 1, wherein the read request is sent via a digital signal having a frequency that is significantly lower than a frequency of the RF signal.

3. The method of claim 1, wherein receiving the read request at a non-volatile memory includes receiving the read request at a one-wire interface of the non-volatile memory; and wherein sending a response includes sending a response from the one-wire interface.

4. The method of claim 1, comprising:

with the capacitor, blocking the DC signal from reaching a ground connection of the non-volatile memory.

5. The method of claim 1, comprising:

with the capacitor, bypassing the RF signals past the non-volatile memory as the RF signals propagate between the antenna and the transceiver unit.

6. The method of claim 1, comprising:

filtering the RF signals before an input into the non-volatile memory.

7. The method of claim 1, wherein the transceiver unit includes an RF transceiver configured to send and to receive the radio frequency (RF) signals and an antenna identifying circuit configured to send the read request and to receive the response.

8. The method of claim 7, comprising:

sending a request for attribute information from the antenna identifying circuit of the transceiver unit to the non-volatile memory;

receiving the request for attribute information at the non-volatile memory; and sending a response including the attribute information from the non-volatile memory to the transceiver unit, the attribute information corresponding to the antenna.

9. The method of claim 7, comprising:

sending a write request from the antenna identifying circuit of the transceiver unit to the non-volatile memory, the write request including information to write to the non-volatile memory;

receiving the write request at the non-volatile memory; and storing the information in the write request in the non-volatile memory.

10. An in-line antenna identifying device, comprising:

a first coax connector configured to connect to a coaxial cable, the first coax connector including an inner conductor configured to contact a signal conductor of a coaxial cable connected thereto and a ground contact configured to contact a metal shield of the coaxial cable connected thereto;

a second coax connector configured to connect to a coaxial cable, the second coax connector including an inner conductor configured to contact a signal conductor of a coaxial cable connected thereto and a ground contact configured to contact a metal shield of the coaxial cable connected thereto, wherein radio frequency (RF) signals received on either of the inner conductors are coupled to the other of the inner conductors;

a non-volatile memory physically coupled to and between the first coax connector and the second coax connector such that the non-volatile memory can send and receive signals over the inner conductor of the first coax connector, the non-volatile memory configured to obtain operating power from a direct current voltage provided over a coaxial cable connected to the first coax connector, wherein the non-volatile memory has an identifier stored therein for identifying an antenna coupled to the second coax connector and is configured to send the identifier over the inner conductor in response to a read request received over the inner conductor;

wherein the non-volatile memory has a one-wire serial interface coupled to the inner conductor of the first coax connector and a ground contact coupled to the inner conductor of the second coax connector; and a capacitor in series between the first coax connector and the second coax connector such that a first end of the capacitor is coupled to the inner conductor of the first coax connector and the second end of the capacitor is coupled to the inner conductor of the second coax connector, wherein the one-wire serial interface of the non-volatile memory is coupled to the first end of the capacitor and the ground contact of the non-volatile memory is coupled to the second end of the capacitor.

11. The in-line antenna identifying device of claim 10, wherein the non-volatile memory is configured to communicate over the inner conductor of the first coax connector using a digital signal having a frequency significantly lower than a radio frequency used for the RF signals coupled from either of the inner conductors to the other inner conductor.

12. The in-line antenna identifying device of claim 11, wherein the non-volatile memory is configured to be grounded when a grounded antenna is coupled to the second coax connector thereby coupling a ground to the inner conductor of the second coax connector.

13. The in-line antenna identifying device of claim 12, wherein the non-volatile memory is configured to send the identifier from the one-wire serial interface in response to a read request received at the one-wire serial interface, and wherein the non-volatile memory is configured to obtain operating power from the inner conductor of the first coax connector.

14. The in-line antenna identifying device of claim 10, wherein the non-volatile memory includes an erasable programmable read only memory (EPROM).

15. The in-line antenna identifying device of claim 10, wherein the non-volatile memory includes attribute information corresponding to the antenna.

16. The antenna unit of claim 15, wherein the attribute information includes one or more of a location of the antenna, a type of the antenna, and a frequency band for the antenna.

17. A system, comprising:

a transceiver unit coupled to a first section of a coaxial cable and configured to send and receive RF signals over a signal conductor of the coaxial cable;

an antenna coupled to a second section of the coaxial cable;

a capacitor coupled between the first and second sections of the coaxial cable;

a non-volatile memory coupled across the capacitor such that the non-volatile memory is configured to send and to receive signals over the coaxial cable, the non-volatile memory configured to obtain operating power from a direct current (DC) voltage across the capacitor;

wherein the transceiver unit includes an antenna identifying circuit configured to send a read request over the coaxial cable to the non-volatile memory; and wherein the non-volatile memory has an identifier stored therein for identifying the antenna and is configured to send the identifier over the coaxial cable in response to the read request received over the coaxial cable.

18. The system of claim 17, wherein the transceiver unit is configured to send a generic read request over the coaxial cable, the generic read request configured to cause any antenna identifying non-volatile memory coupled to the coaxial cable or a coaxial cable in series with the coaxial cable to respond with its respective identifier.

19. The system of claim 17, wherein the antenna is coupled to the second state of the coaxial cable, the system comprising:

a splitter/combiner coupled to the second section of the coaxial cable and a plurality of coaxial cables each in series between the second section of the coaxial cable and respective antennas of a plurality of antennas, the splitter/combiner configured to split and combine RF signals between the coaxial cable and the plurality of coaxial cables, wherein the splitter/combiner is configured to pass the DC voltage from the coaxial cable to the plurality of coaxial cables and is configured to couple a read request on the coaxial cable to the plurality of coaxial cables and is configured to couple a response on any of the plurality of coaxial cables to the coaxial cable.

20. The system of claim 17, wherein the transceiver unit is configured to couple the DC voltage to the first section of the coaxial cable.

21. The system of claim 17, comprising:

a host unit for a digital antenna system (DAS);

wherein the transceiver unit is located remotely from the host unit and is communicatively coupled to the host unit;

wherein the host unit is configured to communicate a downstream transport signal from the host unit to the transceiver unit; and wherein the transceiver unit is configured to use the downstream transport signal to generate a downstream RF signal to send over the coaxial cable for radiation from the antenna.

22. The system of claim 21, wherein:

the transceiver unit is configured to generate an upstream transport signal from an upstream RF signal received via the antenna;

the transceiver unit is configured to communicate the upstream transport signal from the transceiver unit to the host unit; and the host unit is configured to use the upstream transport signal to generate a upstream signal that is provided by the host unit to at least one base-station related node.

23. The system of claim 22, wherein the transceiver unit is configured to generate the upstream transport signal by doing at least one of: down-converting a signal derived from the upstream radio frequency signal; and performing an analog-to-digital conversion (A/D) process on a signal derived from the upstream radio frequency signal.

24. The system of claim 23, wherein the host unit is configured to do at least one of the following in connection with generating the upstream signal from the upstream transport signal: performing a digital-to-analog conversion on a signal derived from the upstream transport signal; and upconverting a signal derived from the upstream transport signal.

25. The system of claim 21, wherein the host unit is coupled to a base-station related node.

26. The system of claim 25, wherein the base-station related node comprises at least one of a base station, a radio access controller, and a base station controller.

27. The system of claim 21, wherein the host unit is configured to receive the downstream RF signal from a base station and to generate the downstream transport signal from the downstream radio frequency signal.

28. The system of claim 21, wherein the host unit is configured to receive digital downstream baseband data from a base station related node and to generate the downstream transport signal from the digital downstream baseband data.

29. The system of claim 21, wherein the DAS comprises at least one of an analog DAS and a digital DAS.

30. The system of claim 21, wherein the host unit is configured to generate the downstream transport signal by doing at least one of: generating digital downstream baseband data using a base band module or a base station module included in the host unit; performing an analog-to-digital conversion on a signal derived from the downstream signal; and frequency shifting a signal derived from the downstream signal.

31. The system of claim 21, wherein the transceiver unit is configured to do at least one of the following in connection with generating the downstream RF signal from the downstream transport signal: performing a digital-to-analog conversion on a signal derived from the downstream transport signal; up-converting a signal derived from the downstream transport signal; filtering a signal derived from the downstream transport signal; and amplifying a signal derived from the downstream transport signal.

32. The system of claim 21, wherein:

the host unit is configured to send a request to the transceiver unit, the request to identify antennas coupled to the transceiver unit; and wherein the transceiver unit is configured to send the read request in response to the request to identify antennas, wherein the transceiver unit is configured to provide the identifier for the antenna to the host unit.

33. The system of claim 21, wherein:

the transceiver unit is configured to send a request for attribute information from the antenna identifying circuit to the non-volatile memory; and wherein the non-volatile memory is configured to receive the request for attribute information and to send a response including the attribute information to the transceiver unit, the attribute information corresponding to the antenna.

34. The system of claim 33, wherein:

the transceiver unit is configured to send a write request from the antenna identifying circuit to the non-volatile memory, the write request including information to write to the non-volatile memory; and the non-volatile memory is configured to store the information in the write request in the non-volatile memory.

* * * * *